US005184145A

United States Patent [19]

Devillers et al.

[11] Patent Number: 5,184,145

[45] Date of Patent: Feb. 2, 1993

[54] DISMOUNTABLE AND AIR-TRANSPORTABLE ANTENNA FOR TWO-WAY TELECOMMUNICATIONS WITH A SATELLITE

[75] Inventors: Yves Devillers, Paris; Frédéric Neveu, Carrieres Sous Poissy; Roger Behe, Cap D'ail; Pierre Ramat, Rueil Malmaison, all of France

[73] Assignee: Minister of the Post, Telecommunications and Space (Centre National D'Etudes Des Telecommunications), Issy Les Moulineaux, France

[21] Appl. No.: 547,083

[22] Filed: Jul. 5, 1990

[30] Foreign Application Priority Data

Jul. 6, 1989 [FR] France ..... 89-09092

[51] Int. Cl.[5] ..... H01Q 1/080; H01Q 3/020; H01Q 15/160; H01Q 19/130

[52] U.S. Cl. ..... 343/840; 343/880; 343/916

[58] Field of Search ..... 343/840, 915, 916, 878, 343/880, 912

[56] References Cited

U.S. PATENT DOCUMENTS

| | | | |
|---|---|---|---|
| 4,575,726 | 3/1986 | Gounder | 343/840 |
| 4,647,943 | 3/1987 | Metcalfe | 343/840 |
| 4,656,486 | 4/1987 | Turner | 343/882 |
| 4,766,443 | 8/1988 | Winegard et al. | 343/840 |
| 4,862,188 | 8/1989 | Monvoisin et al. | 343/840 |

FOREIGN PATENT DOCUMENTS

| | | | |
|---|---|---|---|
| 0204614 | 12/1986 | European Pat. Off. . | |
| 0293877 | 12/1988 | European Pat. Off. . | |
| 0042204 | 2/1988 | Japan . | |
| 0195702 | 8/1989 | Japan . | |
| 0272206 | 10/1989 | Japan . | |
| 0642809 | 1/1979 | U.S.S.R. | 343/713 |

*Primary Examiner*—Rolf Hille
*Assistant Examiner*—Peter Toby Brown
*Attorney, Agent, or Firm*—Lowe, Price, LeBlanc & Becker

[57] ABSTRACT

The antenna is preferably of the offset type and comprises plural thin and separable parabolic elements jointed into a parabolic reflector, and several substantially rectangular separable panels assembled into a prismatic lattice frame for supporting the reflector. The panels are substantially perpendicular to the lower base of the lattice and have curved upper edges formed in a duplicate mould according to the reflector and separable from the reflector elements. The antenna also comprises a telescopic elevation angle lifting mast and a circular aximuth positioner, both jointed to the frame and dismountable. The dismounted antenna is transportable in the form of standardized packages in the hold of long-distance airliner.

15 Claims, 19 Drawing Sheets

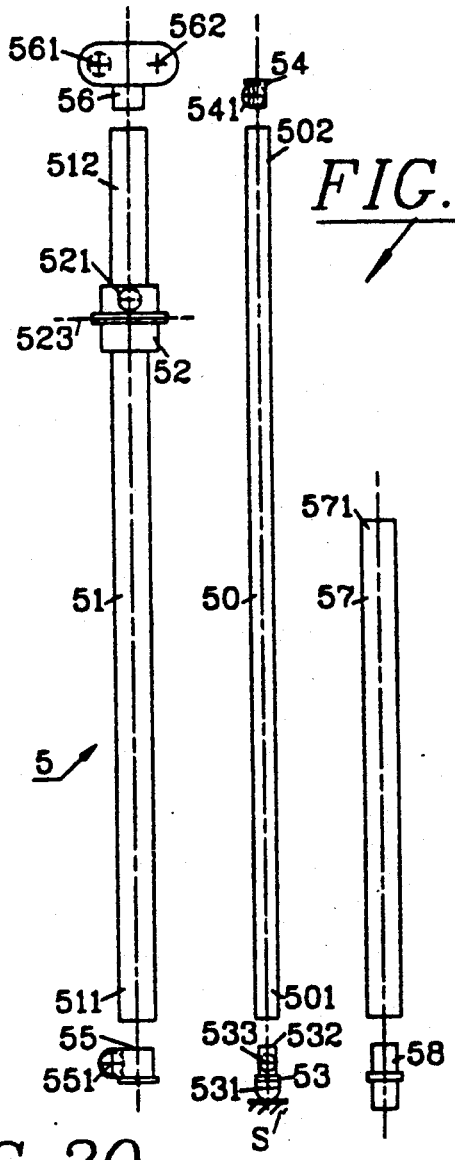
FIG. 18
FIG. 19
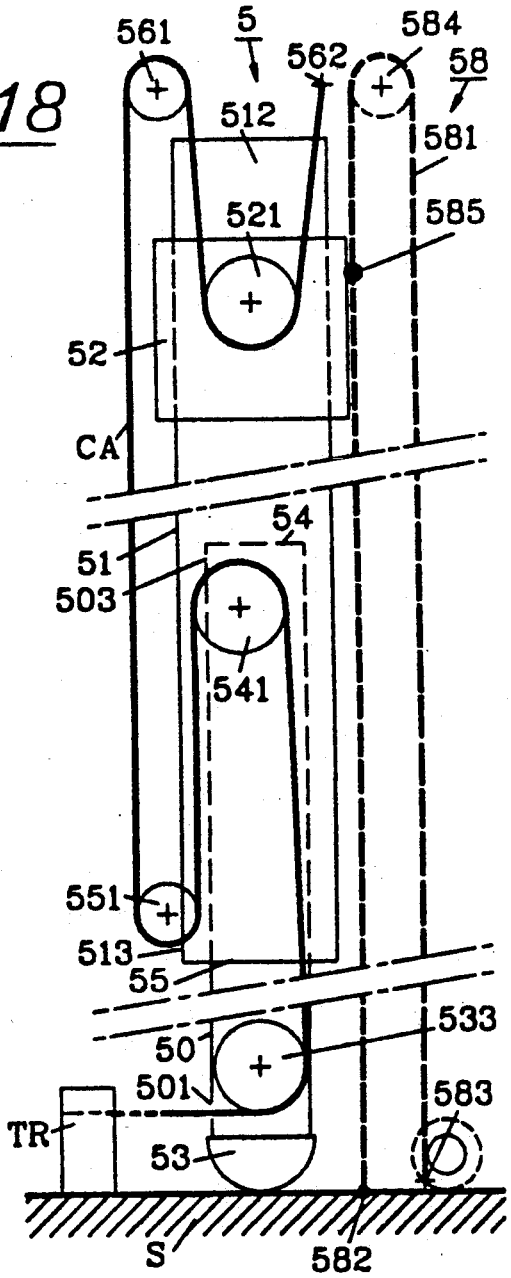
FIG. 20
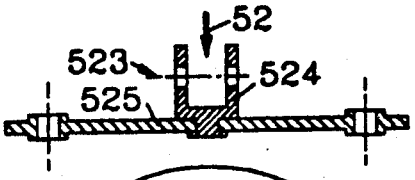
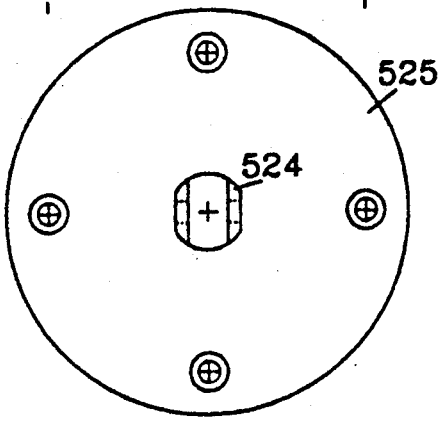
FIG. 21

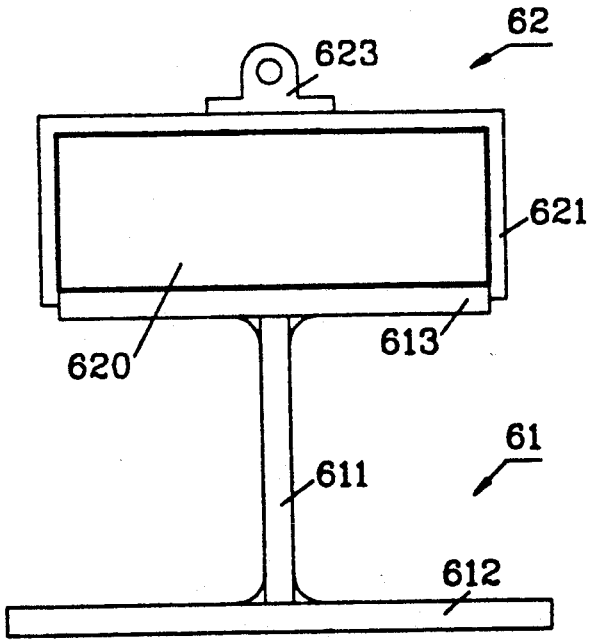
FIG. 25
FIG. 26
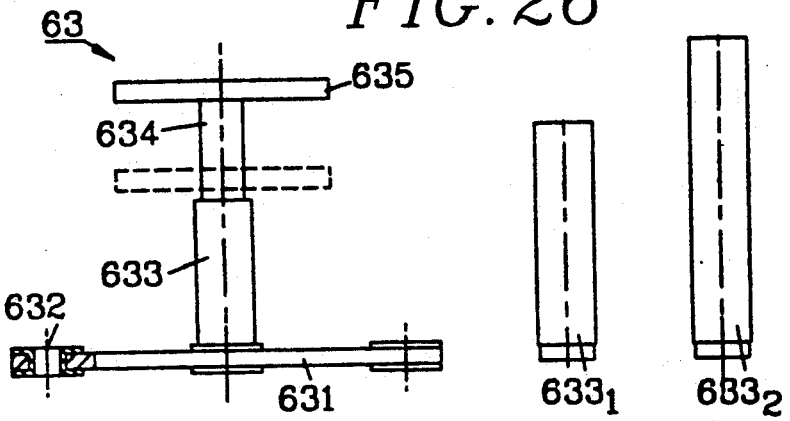
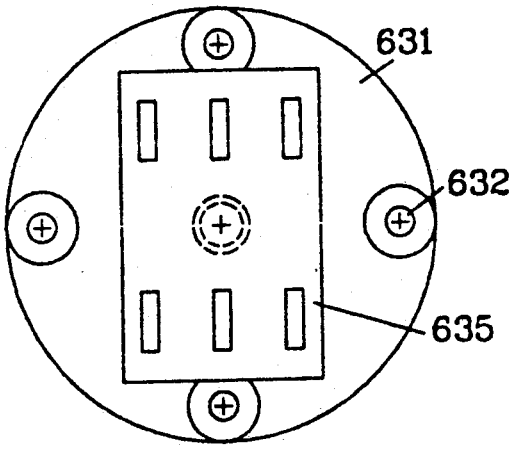
FIG. 27

DISMOUNTABLE AND AIR-TRANSPORTABLE ANTENNA FOR TWO-WAY TELECOMMUNICATIONS WITH A SATELLITE

BACKGROUND OF THE INVENTION

1. Field of the Invention

This invention relates to a transportable antenna for a mobile earth telecommunications station, enabling notably the transmission and reception of images, sound and data with a telecommunications satellite. In particular, it is used for distant coverages in order to retransmit television images and to exchange telephone communications with a television control center in the home country.

2. State of the Prior Art

Currently, the known mobile antennae, given their form and their ground stabilizing equipment, never weigh less than two tons and are not sufficiently dismountable for fast and inexpensive transport by aircraft to the site of intervention. Moreover, the same is true of the electronic equipment associated with the antenna, said equipment being confined in a large technical protection shelter of which the bulkiness and weight are handicaps.

Furthermore, the weight and bulkiness of the equipment and the antenna contributed, by the cost involved, in preventing the conducting of long-distance coverage with images and sound. The users of such antennae, the foremost of which are television channels and private clients, have always considered such coverage to be impossible.

It should be stressed that the main drawback of these known antennae is the fact that they are not dismountable into relatively small parts enabling them to be grouped into parcels that can be easily transported in the holds of long-distance airliners. In fact, the reflector and the frame, which are of the irregular tubular lattice type, are not completely separable from one another. The reflector-frame assembly can be dismounted into a few reflector-frame parts that are of various non-standard forms and of great volume. The dimensions of these parts exceed the maximum length, width and height of 3.07 m, 1.8 m and 1.6 m for packages in the, holds of long-distance airliners. Under these conditions, these known antennae are transported by air in planes called cargos which are specially chartered and whose schedules are highly irregular. This entails a much longer unoperational period for the equipment and antenna than that required time for the separate transportation of the reporting team. In certain cases, the equipment and antenna cannot even be routed by small plane or helicopter to the exact location of direct coverage.

Furthermore, existing and dismountable antennae, which are already too heavy, have are latively small diameter and therefore insufficient radio electrical performances. The hyper frequency source of the antenna must provide a very high output at transmission to achieve the quality objectives required for retransmission of the coverage. In turn, this high output weighs heavily on the transportability qualities of the equipment and antenna as well as on the cost of routing and human services insofar as higher hyper frequency source power requires heavier electronic equipment. In particular, the equipment requires a power supply of very high output, thereby increasing the bulkiness and the weight of the assembly.

OBJECTS OF THE INVENTION

The main object of this invention is to remedy the preceding disadvantages, particularly to provide a light antenna, easily dismountable into various compact parts, and therefore easily transportable by air.

Another object of this invention is to provide an air-transportable antenna having a power supply of relatively low electrical output, in order to make quick coverage possible throughout the world and to retransmit television images notably towards a geostationary satellite.

A further object of this invention is to provide an antenna transportable in the hold of a long-distance airliner at the same time as the reporting team itself.

SUMMARY OF THE INVENTION

Accordingly, an antenna, notably for two-way telecommunications with a satellite, therein comprises plural thin and separable parabolic elements having a substantially uniform thickness and jointed into a parabolic reflector, and plural substantially rectangular separable panels assembled into a lattice frame configured as a prism for supporting the reflector. The panels are substantially perpendicular to the lower base of the lattice and have curved upper edges that are adapted, following a duplicate moulding operation, according to the convex side of the reflector and that are separable from the reflector elements.

The reflector elements and the frame panels are each inscribed in a predetermined rectangle, preferably of approximately 3 m$\times$1.5 m, and each have a sandwich structure composed of a core in synthetic material or honeycombs or light wood, and sides in carbon fibers. The surface mass of the reflector elements and frame panels can be less than approximately 11 kg/m$^2$, and preferably in the region of 5 kg/m$^2$. These dimensional and structural characteristics enable transportation of the antenna embodying the invention in the hold of a long-distance airliner. Transport cost is reduced due to the low weight of the antenna which can have an overall weight, inclusive of its accessories such as source carrier mast, elevation angle mast and azimuth positioner, of less than 400 kg.

The relatively large dimensions of the reflector embodying the invention authorize a low output hyperfrequency source and a light and compact electric energy supply.

According to a preferred embodiment, the antenna is of the offset type and therefore provides greater efficiency than the commonly used rotational symmetrical reflector type antennae. The antenna comprises a source carrier mast of which the lower part is laterally attached to one of the lateral panels of the frame and of which the upper part overhanging the reflector is located parallel to and close to the focal axis of the reflector. The source carrier mast can be swivelled in order to be laid down on the antenna and to gain access to the source.

The antenna also comprises dismountable and air-transportable means for orienting the reflector through the elevation angle and through the azimuth. A dismountable elevation angle mast, preferably telescopic, has one end on the ground, a slide part sliding along the elevation angle mast and articulated to one of the lateral panels of the frame, and means for raising the slide part up along the elevation angle mast, are provided for orienting the reflector through the elevation angle.

Two roller bearing means rotationally mounted under one of the lateral panels of the frame and a dismountable runway for the rolling means are provided for orienting the reflector through the azimuth.

The underframe for the antenna embodying the invention is therefore completely different from the traditionally used underframes using a turret for orienting through the azimuth and actuator levers mounted on the turret for orienting through the elevation angle. In particular, the elevation angle mast embodying the invention enables the frame supporting the reflector to be placed on the ground.

BRIEF DESCRIPTION OF THE DRAWINGS

Further features and advantages of the invention will be apparent from the following particular description of several preferred embodiments of this invention as illustrated in the corresponding accompanying drawings in which:

FIG. 18 is an exploded view of a elevation angle mast of the antenna;

FIG. 19 is a schematic diagram of the elevation angle mast partially unfolded;

FIGS. 20 and 21 are respectively top and front views of an articulation fork between the elevation angle mast and a small lateral panel of the frame;

FIG. 25 is a side view of a runway girder for frame supporting block included in the azimuth positioner;

FIGS. 26 and 27 are respectively vertical and top views of a screw jack for levelling the runway;

DESCRIPTION OF THE PREFERRED EMBODIMENTS

In order to clarify matters, certain components and dimensions of elements making up an antenna in accordance with the invention are indicated as examples in the detailed description hereinunder.

The antenna according to a first preferred embodiment is destined to transmit toward a geostationary satellite and to receive from this satellite SHF telecommunication signals in centimetric wave, and more particularly signals in C-band, respectively between 3.1 and 4.2 GHz and 5.925 and 6.425 GHz. The telecommunications signals can simultaneously carry images, sound and computer data.

Figure 1:
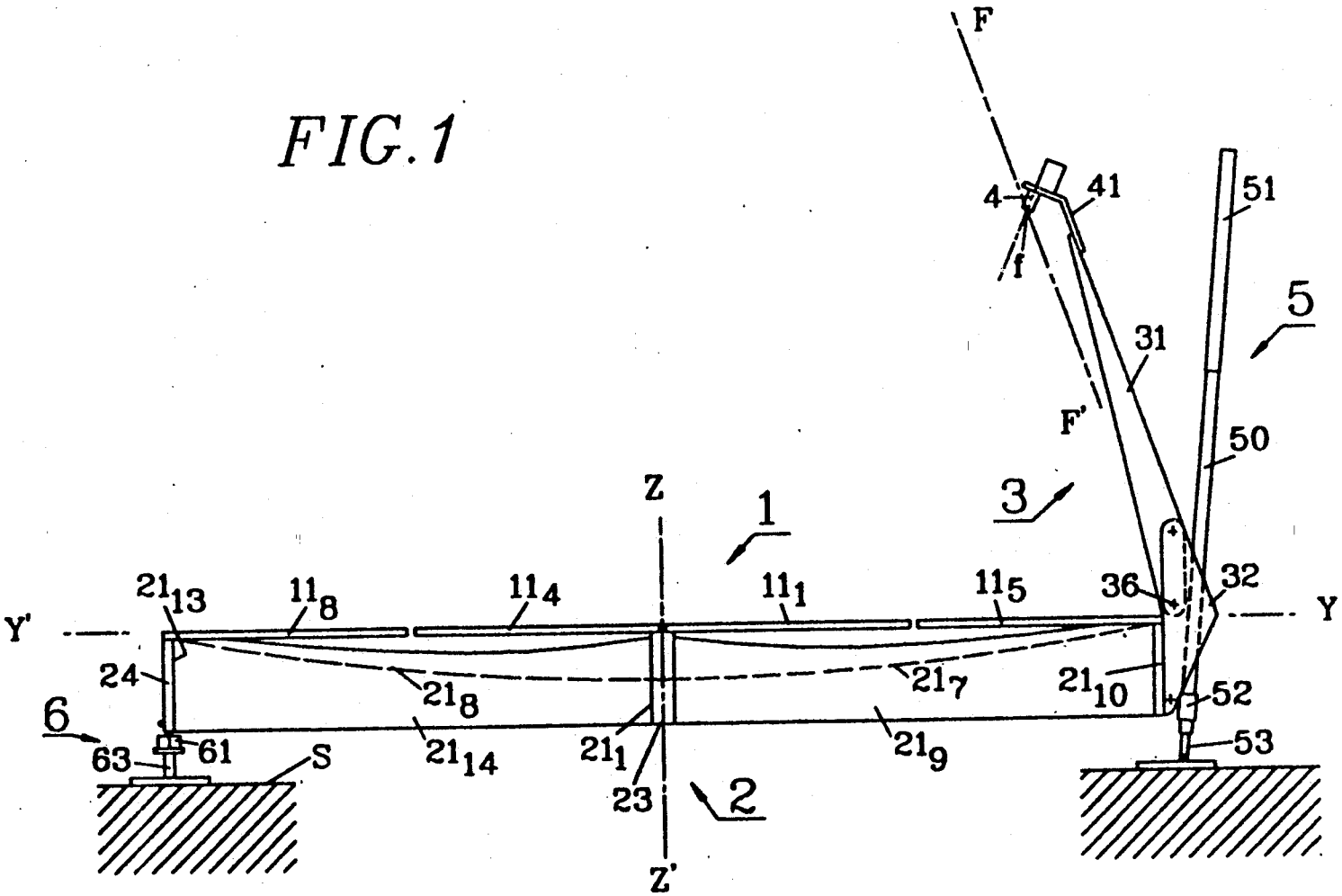
FIG. 1 is a schematic view of the longitudinal side of a frame and a reflector of an antenna according to a first embodiment of the invention positioned horizontally.
Figure 2:
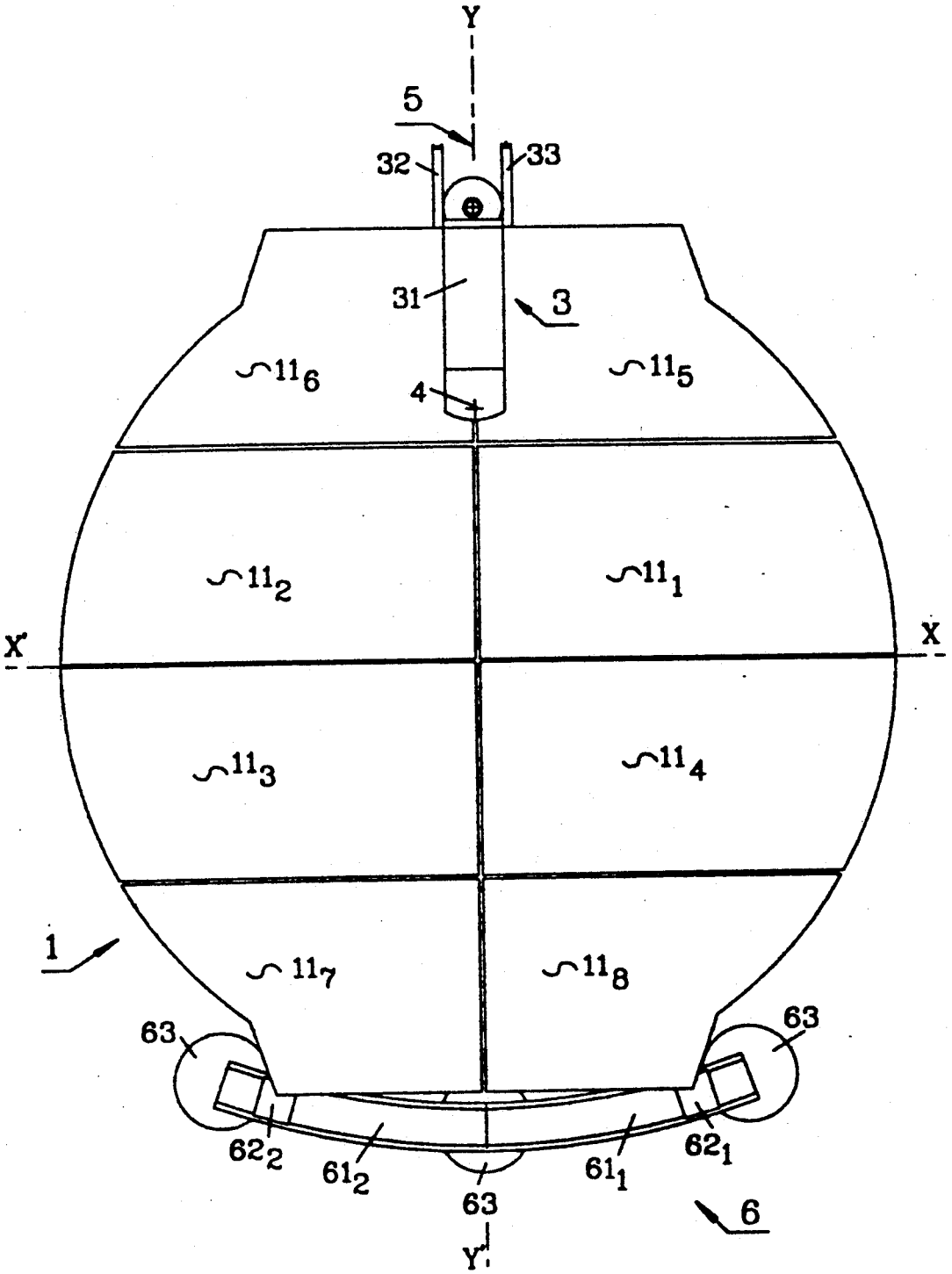
FIG. 2 is a schematic top view of the antenna according to FIG. 1.

As shown schematically in FIGS. 1 and 2, the transmission and reception antenna essentially comprises five dismountable assemblies, i.e. a parabolic reflector 1, a forming frame 2, a mast 3 carrying a telecommunications signal source 4, an elevation angle mast 5, and an azimuth positioner 6.

The antenna is of the offset telecommunications signal source type, called "offset antenna". The reflector 1 is a portion without rotational symmetry and with a substantially elliptical contour of a paraboloid of revolution. The projection of the reflector onto a focal plane perpendicular to the axis F'F of the paraboloid is a circle of projection passing near the focus f of the paraboloid. An advantage of the offset antenna is that the mast 3 carrying the source 4 reduces the losses by mask effect and can comprise a single carrying branch which is aligned with the focal axis, which considerably increases the efficiency of the antenna.

The antenna reflector 1 thus has a substantially elliptical contour with very little eccentricity. As shown in the top view in FIG. 3, X'X and Y'Y denote minor and major axes of the elliptical contour in the opening plane of the reflector. The diameter of the projection circle is approximately 5.5 m, and the reflector 1 is seen from the focus f where the hyperfrequency source 4 is located, from an apex angle of approximately $2\times40°=80°$. The width and length of the reflector along the X'X and Y'Y axes are in the region of 5.4 m and 5.9 m, which corresponds to an area of approximately 25 $m^2$.

The reflector 1 is dismountable into eight thin parabolic elements, called petals $\mathbf{11}_1$ to $\mathbf{11}_8$. The contours of the petals are demarcated on the one hand by the minor axis X'X of the reflector and two segments of a line parallel to axis X'X and from which they are distant by one quarter of the major axis Y'Y, and on the other hand by the major axis Y'Y itself. The continuity of the reflector surface is ensured by butt-jointed junctions of the petals $\mathbf{11}_1$ to $\mathbf{11}_8$ along their edges parallel to the axes X'X and Y'Y. The petals, and consequently the reflector, are thin, i.e. are of small and uniform thickness which facilitates stacking.

Figure 3:
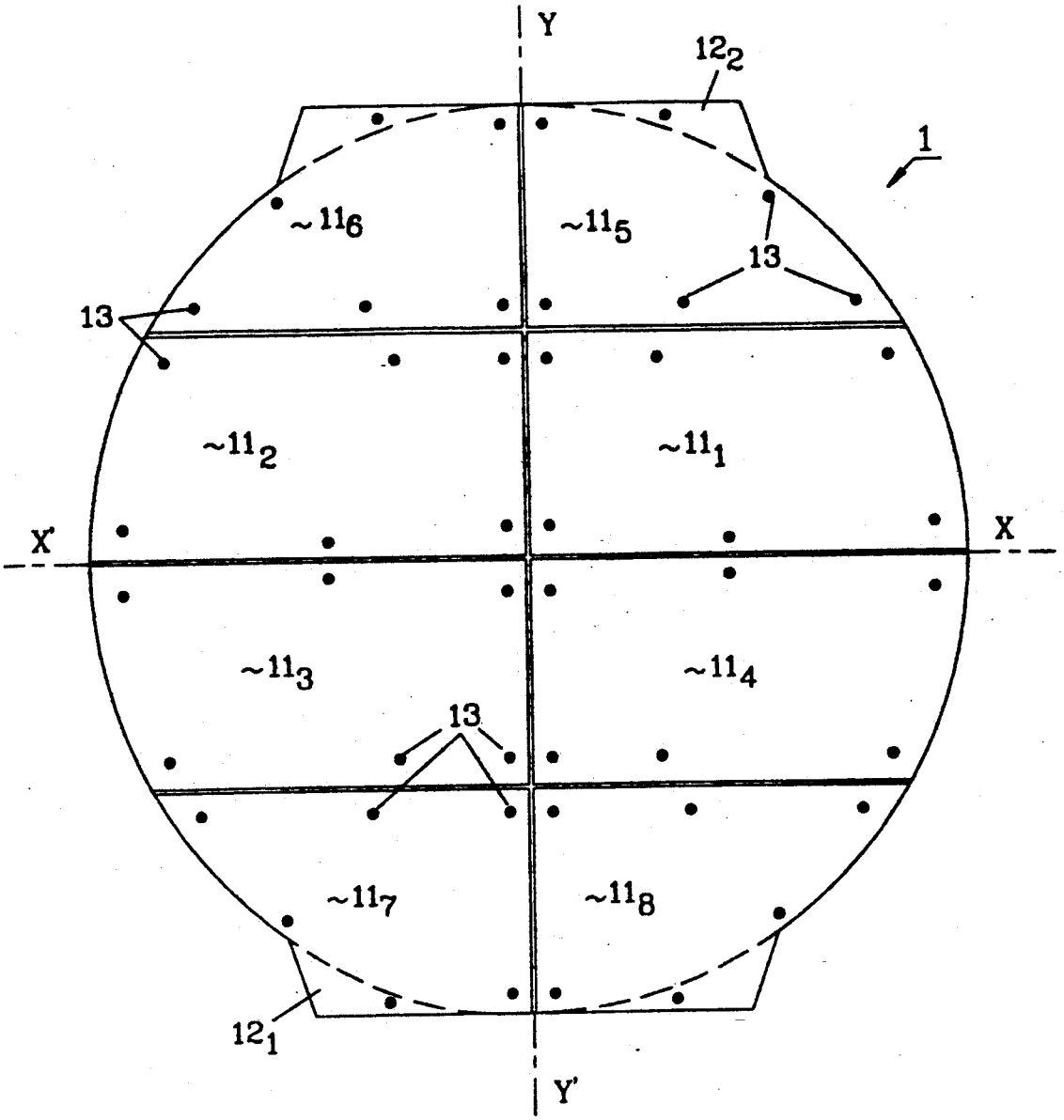
FIG. 3 is a schematic top view of the reflector of the antenna according to FIG. 1.

As appears in FIG. 3, the reflector is in fact comprised of four almost identical central petals 111 to 114 divided up by the axes X'X and Y'Y, and of four almost identical petals 115 to 118 situated at the ends of the major axis Y'Y, which not only facilitates the construction cost of the reflector but also the stacking of the petals when the reflector is dismounted. Moreover, the petal pairs $11_5$ and $11_6$, and $11_7$ and $11_8$ at the ends of the major axis Y'Y comprise trapezoidal overhangs $12_1$ and $12_2$ for forming supports for the reflector on the frame 2, as will be seen hereinafter. Each petal has an area of approximately 3 $m^2$.

Each of the petals $11_1$ to $11_8$ is comprised of a stratified curved panel of the sandwich structure type. Each panel comprises a core which can synthetic thermoformable material such as polymethylmethacrylate foam (PMMA), or in honeycombs, or in light wood such as balsa made tight by the injection of resin. The foam can be reinforced by carbon fibers or by glass fibers. Both sides of the core are covered by one or several layers of carbon fibers impregnated with epoxy resin which, thanks to its almost inexistent coefficient of linear expansion, maintains a constant geometry that is optimal for the petal, irrespective of weather conditions which can vary from −70° C. to +70° C., or when the reflector is partially in the shade and partially in the sun. The concave side of each petal, comprising a reflecting portion of the antenna reflector, comprises a woven grid of aluminum wires aluminium which is glued onto the layers of carbon fibers and protected by a KEVLAR fabric itself coated with a layer of white paint. According to other embodiments the concave face of each petal does not comprise KEVLAR fabric and, the metallic grid and the layer of KEVLAR, i.e., spunlaced fabric are suppressed.

When the petals comprise a balsa core, the thickness of the petals is 14 mm and the reflector has a total mass of approximately 270 kg, i.e. a surface mass of 10.8 $kg/m^2$. In order to obtain the same stiffness in flexure, the petals are 22 mm thick when they have a PMMA core, and the mass of the reflector is much lower, in the region of 135 kg, i e. 5.4 $kg/m^2$.

Figure 4:
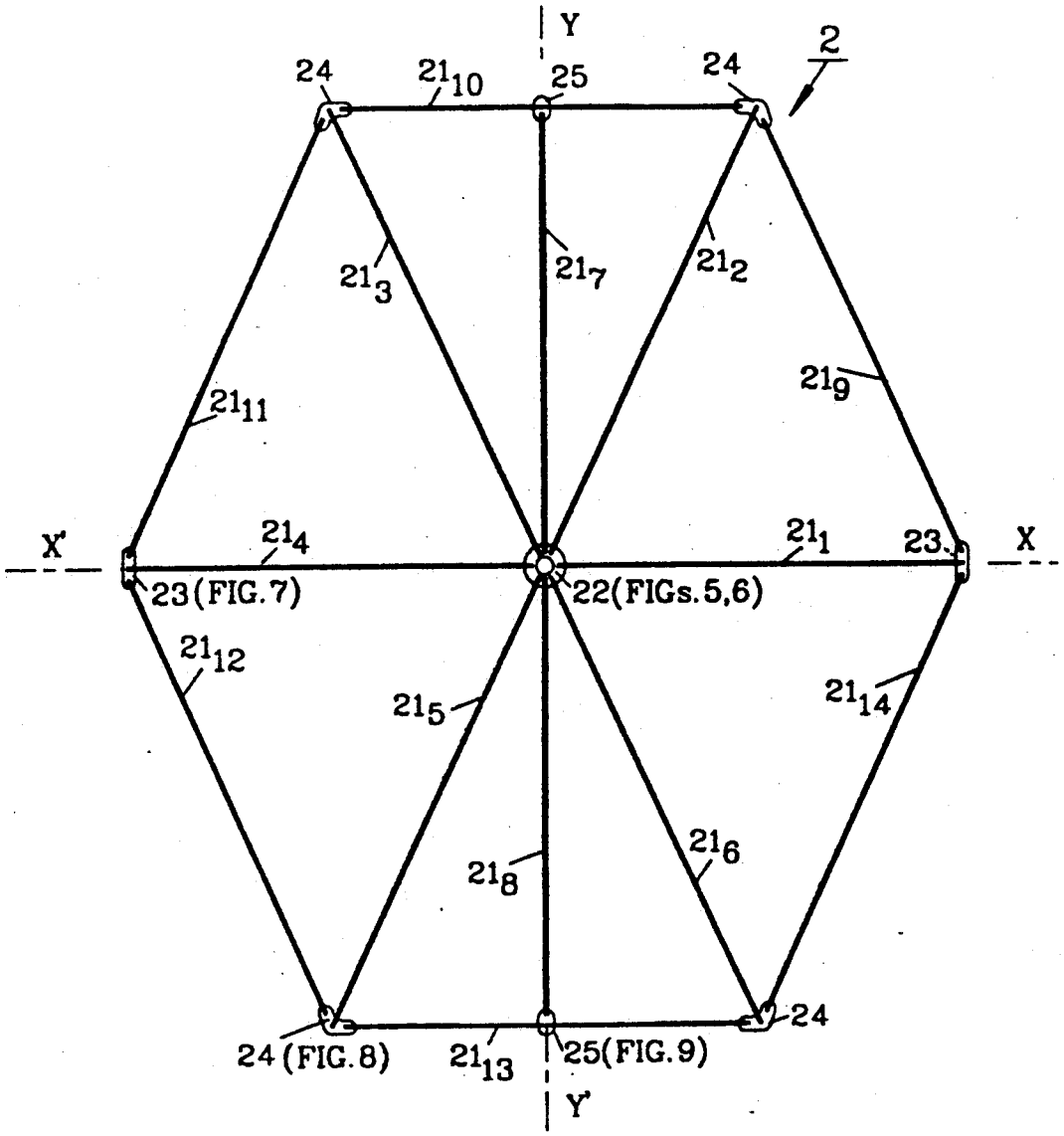
FIG. 4 is a schematic top view of the forming frame of the antenna according to FIG. 1.

According to the embodiment illustrated in FIG. 4, the forming frame 2 is in the shape of an upright prism with a symmetrical and irregular hexagonal base. The prism bases are centered around an axis Z'Z that is central to the reflector 1 and perpendicular to the axes X'X and Y'Y. The bases of the frame have a contour that results from two isosceles trapezoids placed head-to-foot along the minor axis X'X of the reflector 1. The major base of the trapezoids colinear with the major axis X'X is substantially equal to half the minor base of the trapezoids, and the height of the trapezoids is equal to half the major axis Y'Y of the reflector 1. The frame 2 results from the assembly of fourteen panels $21_1$ to $21_{14}$ placed vertically according to FIG. 4 and therefore perpendicularly to the lower base of the prism. Together, the panels of the frame form triangular meshes of a polyhedral lattice. The lower longitudinal edges of the panels are coplanar with the lower base of the prism of the frame. The upper edges of the panels have a curved profile in keeping with the parabolic convex side of the reflector 1. The triangulated structure of the hollow frame 2 comprises on the inside, six panels $21_1$ to $21_6$ connecting the six edges of the frame to the latter's center Z'Z, two panels $21_7$ and $21_8$ along the major axis Y'Y, and six peripheral lateral panels $21_9$ to $21_{14}$ connecting the edges of the frame two-by-two. The panels of the frame are mainly connected to one another by means of a central hub 22 that is coaxial with the axis Z'Z, and by means of six three-tube assemblies 23, 24 situated at the edges of the frame.

Figure 5:
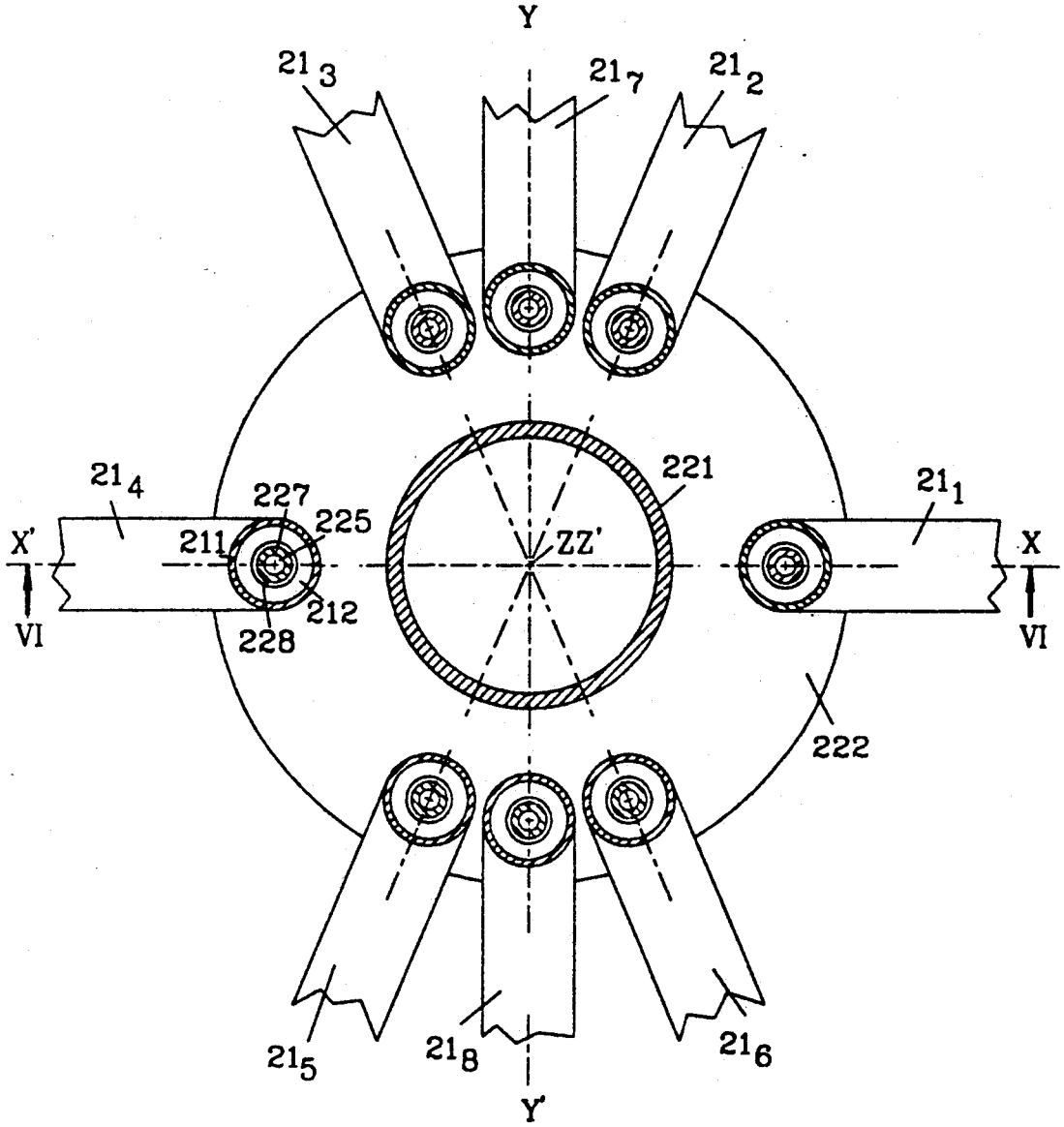
FIG. 5 is a horizontal sectional view taken along the line V—V of FIG. 6 showing a central connection to the frame between the internal panels.
Figure 6:
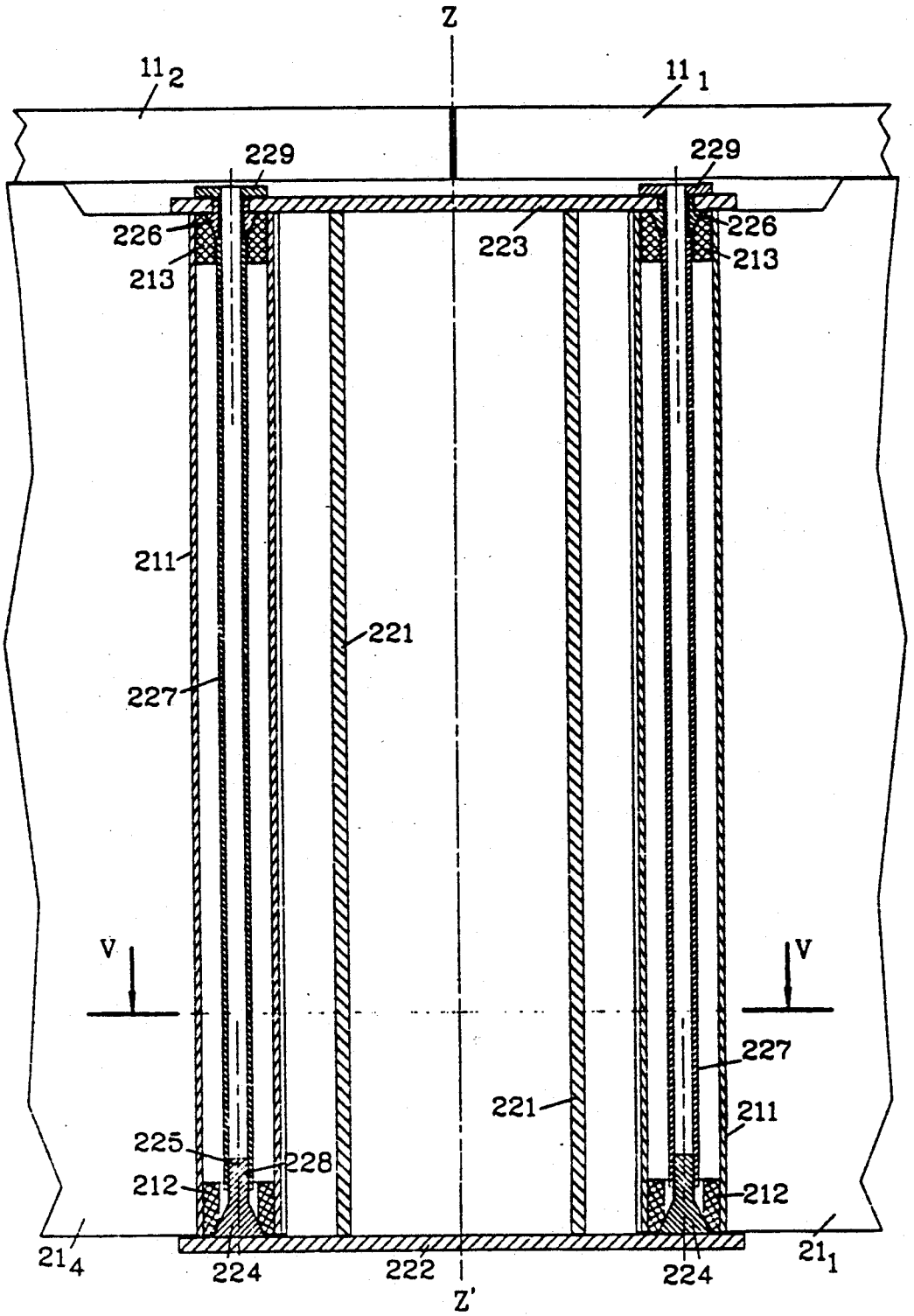
FIG. 6 is a vertical sectional view taken along the line VI—VI of FIG. 5.

The eight interior panels $21_1$ to $21_8$ converge toward the central assembly hub 22. In reference to FIGS. 5 and 6, the hub 22 comprises a central tube 221 and two circular flanges 222 and 223 that are coaxial with the axis Z'Z. The flange 222 is welded at the lower base of the tube 221 whereas the flange 223 is movably mounted on the upper base of the tube 221. On the upper side of the lower flange 222 are welded eight solid conical centering stubs 224 that end with threaded cylindrical ends 225. Likewise, the movable upper flange 223 comprises eight hollow conical centering stubs 226 welded in holes of the flange 223 from which they protrude out. The lower and upper stubs 224 and 226 are aligned in twos parallel to the axis Z'Z, and are spread round a circle that is concentric with the axis Z'Z of the tube 221 according to the star-shaped distribution of the panels $21_1$ to $21_8$. The small vertical edges of these panels are formed by two tubes 211 from the moulding, of which the ends comprise taper bored welded rings 212 and 213 destined to cooperate with two aligned conical stubs 224 and 226. The stub 224 is maintained nested into the lower ring 212, and the stub 226 is maintained nested into the upper ring 213 by means of a hollow rod 227. The tapped lower end 228 of the rod 227 is screwed onto the end

225 of the lower stub 224. The upper end of the rod 227 goes through the stub 226 and comprises a square head 229 applied to the upper side of the flange 223. As appears in FIG. 6, the ends of the upper longitudinal edges of the panels $21_1$ to $21_8$ comprise a small notch in order to lodge there the upper flange 223 under the reflector jointed petals $11_1$ to $11_4$.

The three-tube assemblies situated at the edges of the forming frame 2 are intended to fasten together the small external tubular edges of three panels according to an assembly that is substantially similar to the central hub 22.

Figure 7:
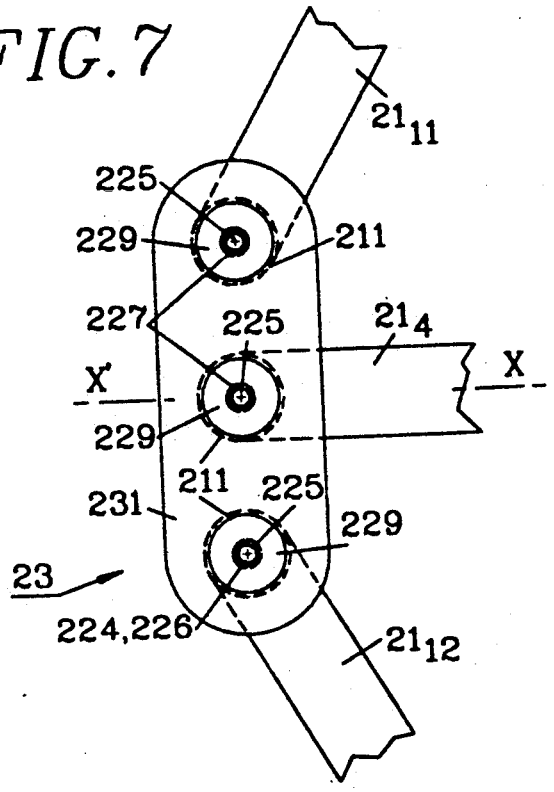
FIGS. 7 and 8 are top views of two connections between panels of the frame at the level of a vertical edge of the frame, respectively.

The two assemblies 23 situated at the two end edges of the minor axis X'X are identical, and one of them for fastening together the big external lateral panel $21_{11}$ and $21_{12}$ and the internal panel $21_4$ is shown in FIG. 7. The assembly 23 comprises upper and lower oblong flanges 231 each fitted with respective conical centering stubs 224, 226 in order to align the neighboring tubes 211 of the panels $21_4$, $21_{11}$ and $21_{12}$ parallel to the major axis Y'Y and symmetrically with regard to the minor axis X'X. Three hollow rods 227 unite the two flanges which brace the ends of the longitudinal edges of the panels $21_4$, $21_{11}$ and $21_{12}$.

Figure 8:
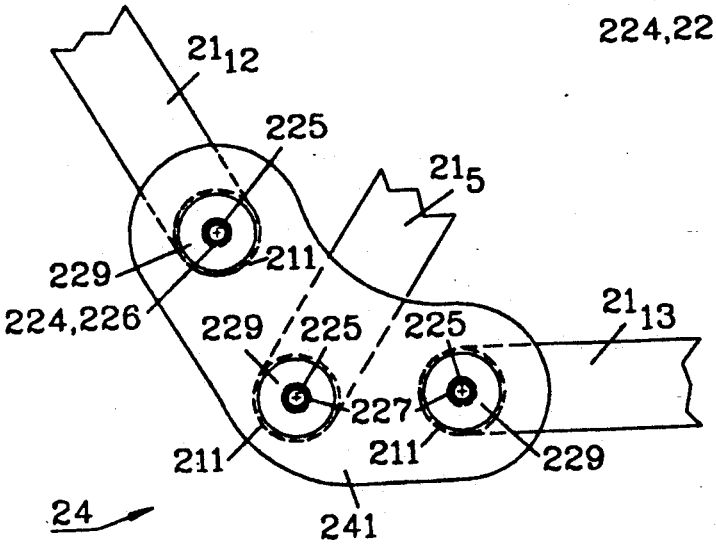

The four assemblies 24 situated at the four edges in the sectors demarcated by the axes X'X and Y'Y are identical, and one of them in relation to the two external lateral panels $21_{12}$ and $21_{13}$ and to the internal panel $21_5$ is shown in FIG. 8. The assembly 24 comprises lower and upper flanges 241 each having three centering stubs 224, 226 like the assembly flanges 231, but having a curved profile that is symmetrical with regard to the internal panel $21_5$. Three rods 227 with upper head 229 and a tapped lower end 228 fasten together the panels $21_{12}$, $21_{13}$ and $21_5$ and the flanges 241.

Figure 9:
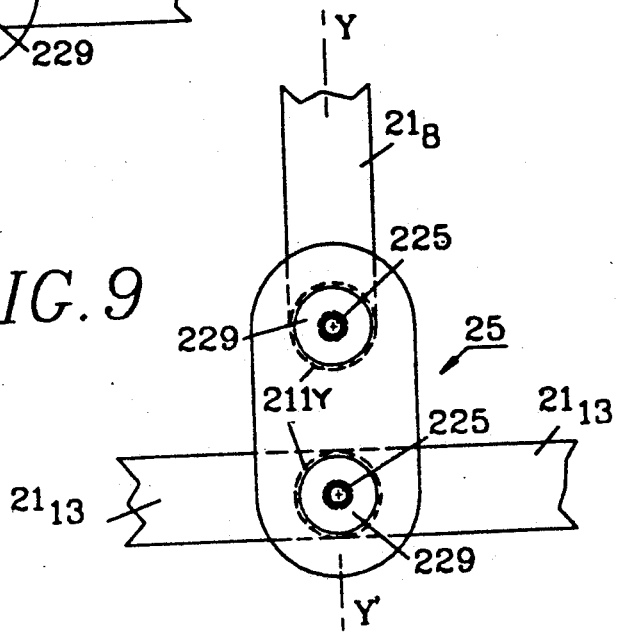
FIG. 9 is a top view of a connection between the middle of a small lateral panel and an internal axial panel of the frame.

The small external lateral panels $21_{10}$ and $21_{13}$ comprise in their center and aligned with the major axis Y'Y a centering tube 211Y embedded during moulding and manufacturing in the core of the panel. As shown in FIG. 9, in order to assemble e.g. one $21_{13}$ of these two external panels with the corresponding internal panel $21_8$ colinear with the axis Y'Y, lower and upper oblong flanges 25 each comprise two respective conical centering stubs 224, 226 which enter the respective ends of the tube 211Y that is central to the external panel $21_{13}$ and of the neighboring end tube 211 of the panel $21_8$. Two rods 227 fasten the flanges 25 to the panels $21_{13}$ and $21_8$.

The forming frame 2 thus comprises $8+(6\times3)+(2\times2)=30$ tube 211 and connection rod 227 assemblies.

In practice, the central hub 22 is approximately 350 mm high, and the peripheral panel assemblies 23, 24 and 25 are approximately 900 mm high.

Figure 10:
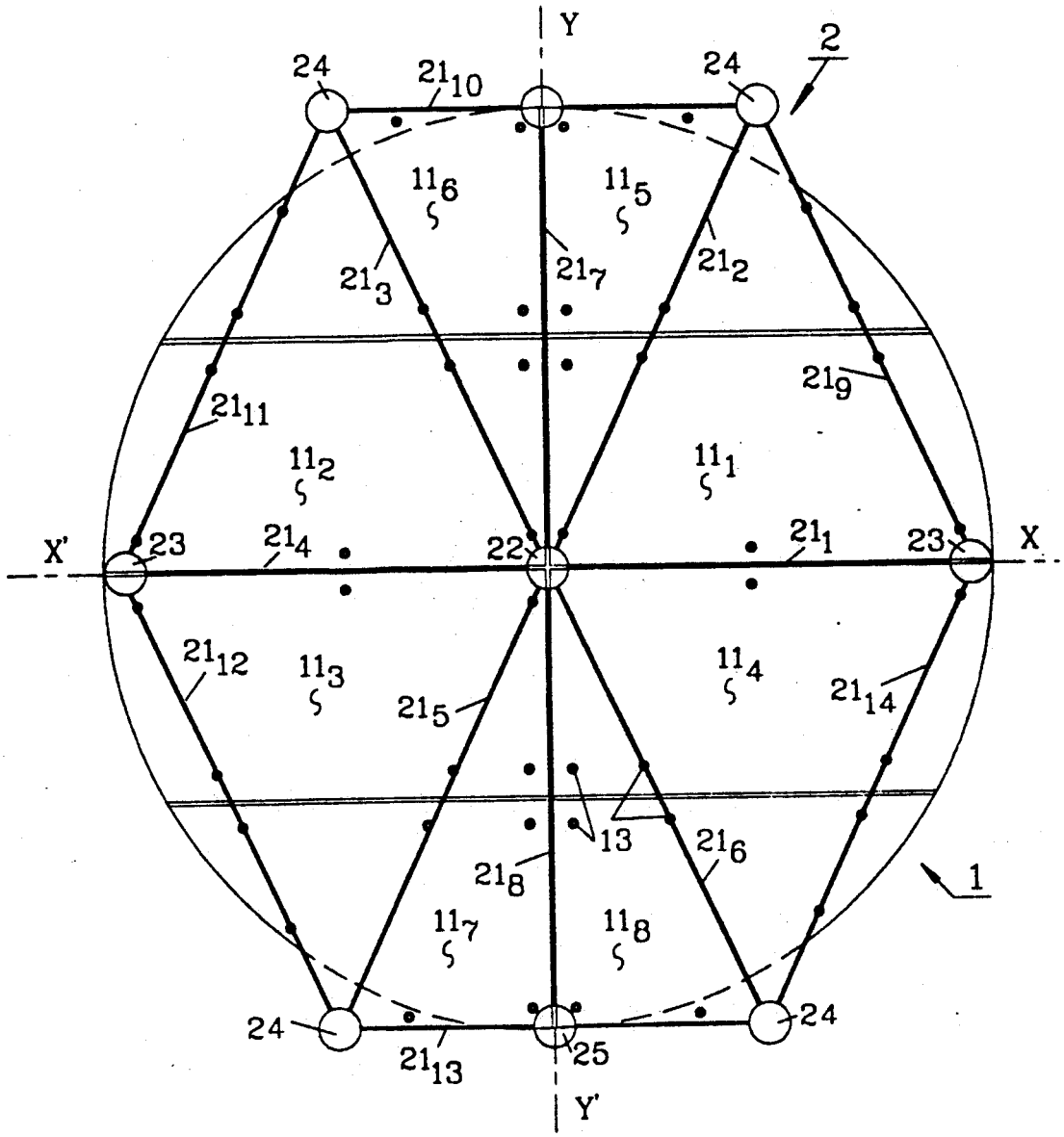
FIG. 10 is a superposition of FIGS. 3 and 4.

When the panels $21_1$ to $21_{14}$ of the forming frame 2 are sufficiently thick, typically with a thickness of 20 mm, the reflector petals $11_1$ to $11_8$ are attached directly to the curved upper edges of the panels. Each petal is thus fastened to the respective subjacent panels by means of six nylon screws 13, typically of 8-mm diameter, spread substantially equidistributed along the periphery of the petal, as shown in FIGS. 3 and 10. Each screw 13 goes through a hole in the petal and is screwed into an expansible and tapped, cylindrical metallic insert that is implanted in the upper longitudinal edge of a panel which is moulded in duplicate, as specified hereinafter.

The triangulated mesh lattice structure thus produced gives the frame 2 considerable stiffness in both flexure and torsion. The six lateral panels $21_9$ to $21_{14}$ perfectly support the petals $11_1$ to $11_8$ so as to avoid any prejudicial flexure in the petals. The screws 13 are conical screws so as to permanently ensure perfect butt-jointing of the petals and to avoid all risks of crushing during assembly of the latter by unqualified professionals. The general architecture of the reflector 1 and the frame 2 stiffening the reflector endow the antenna with excellent stability in violent winds. The presence of panels inside the frame prevents winds from rushing in under the reflector.

Each of the panels $21_1$ to $21_{14}$ of the frame 2 also has a sandwich structure comprised of a core, preferably in PMMA foam, or a core in an identical material to that of the petals, the sides of which are covered by one or several films of carbon fibers. For a panel core in PMMA, the mass of the frame 2 is approximately 160 kg.

Figure 11:
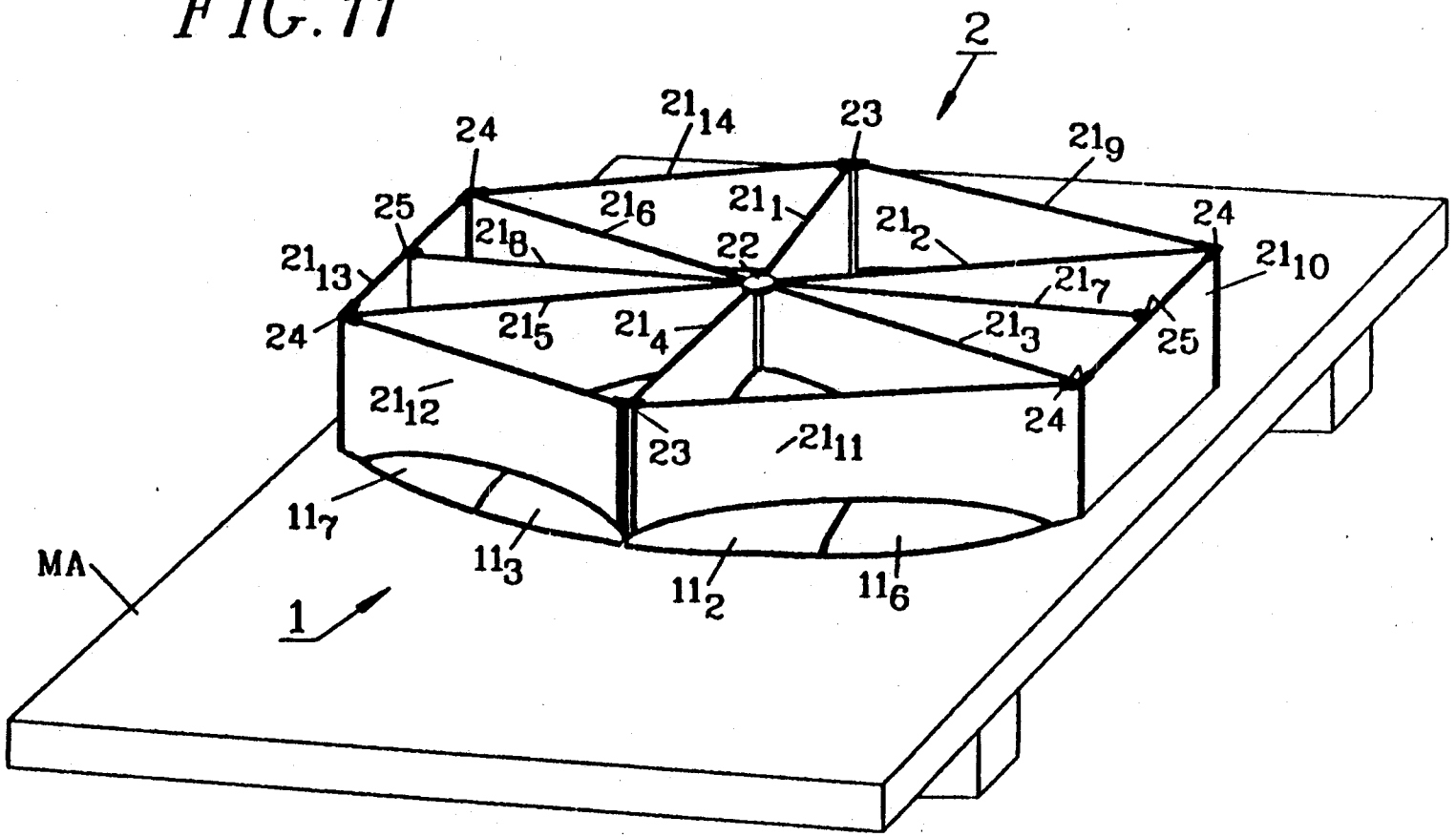
FIG. 11 is a schematic perspective view of the reflector on a mould, and of the overturned frame being duplicate moulded according to a first embodiment.

The manufacture of the reflector 1 and of the forming frame 2 such as they have just been described preferably comprises the following stages, in reference to FIG. 11.

a) The antenna reflector 1 is formed from a parabolic convex male mould MA of which the geometry, which is not rotational symmetrical, has previously been verified.

b) The panels $21_1$ to $21_{14}$ are cut out to the required profile and, in particular, their upper edge is machined approximatively as a function of the lower concave side of the reflector 1. Then the panels are connected to one another by means of the central hub 22 and the flange assemblies 23, 24 and 25.

c) The antenna reflector, still on the male mould MA in the form of a paraboloid, receives on top of it the overturned forming frame which is suitably positioned on the reflector, as shown in FIG. 11. However, prior to placing the frame on the mould, the non-active convex side of the reflector is covered with a stripping film, and the epoxy resin is spread over the film, approximatively to the corresponding junctions between the panels and the reflector. The resin can be broadly spread out to form duplicate moulded splicing angles of a given width along and on each side of the curved longitudinal edges of the stiffening panels $21_1$ to $21_{14}$. In certain embodiments, the splicing angles can be used to receive petal fastening screws, or to support the petals when the panels are thin.

d) After thermosetting of the duplicate moulding resin, the longitudinal concave edges of the frame panels are a perfect fit for the parabolic form of the reflector. The position of the frame on the reflector is precisely marked, and/or if necessary, holes are drilled and countersunk between the splicing angles 24 of the frame 2 and the petals 111 to 118 of the reflector 1, especially for fastening screws 13.

It should be noted that assembly of the antenna reflector and forming frame by mechanical fastening enables the antenna to be dismounted while ensuring the geometry of the reflector determined during moulding. The duplicate moulding on the panel edges and, if necessary, the splicing as well as the drilling and countersinking must necessarily be carried out before the antenna reflector is separated from its mould.

e) After dismounting the frame 2 and removing its panels, the duplicate moulded edges of the panels are cleaned and burred. Then the reflector is cut out to the required profile in several petals, in this instance, into eight petals $11_1$ to $11_8$.

The main advantage of the forming frame 2 being independently dismountable from the antenna reflector 1 is to offer, after dismounting, as small a volume as possible, thereby facilitating transportation of the panels of the forming frame, especially by aircraft. The mass of each of the elements, whether reflector petals or frame panels, does not exceed 20 kg, and the length and width of each of these elements are less than 3 m and 1.5 m, and therefore less than the standard pallet dimensions of 3.07 m×1.8 m for long-distance airliners. These characteristics enable easy assembly of the frame and reflector, without handling means ever being required, as well as compact stacking of the elements.

Figure 12:
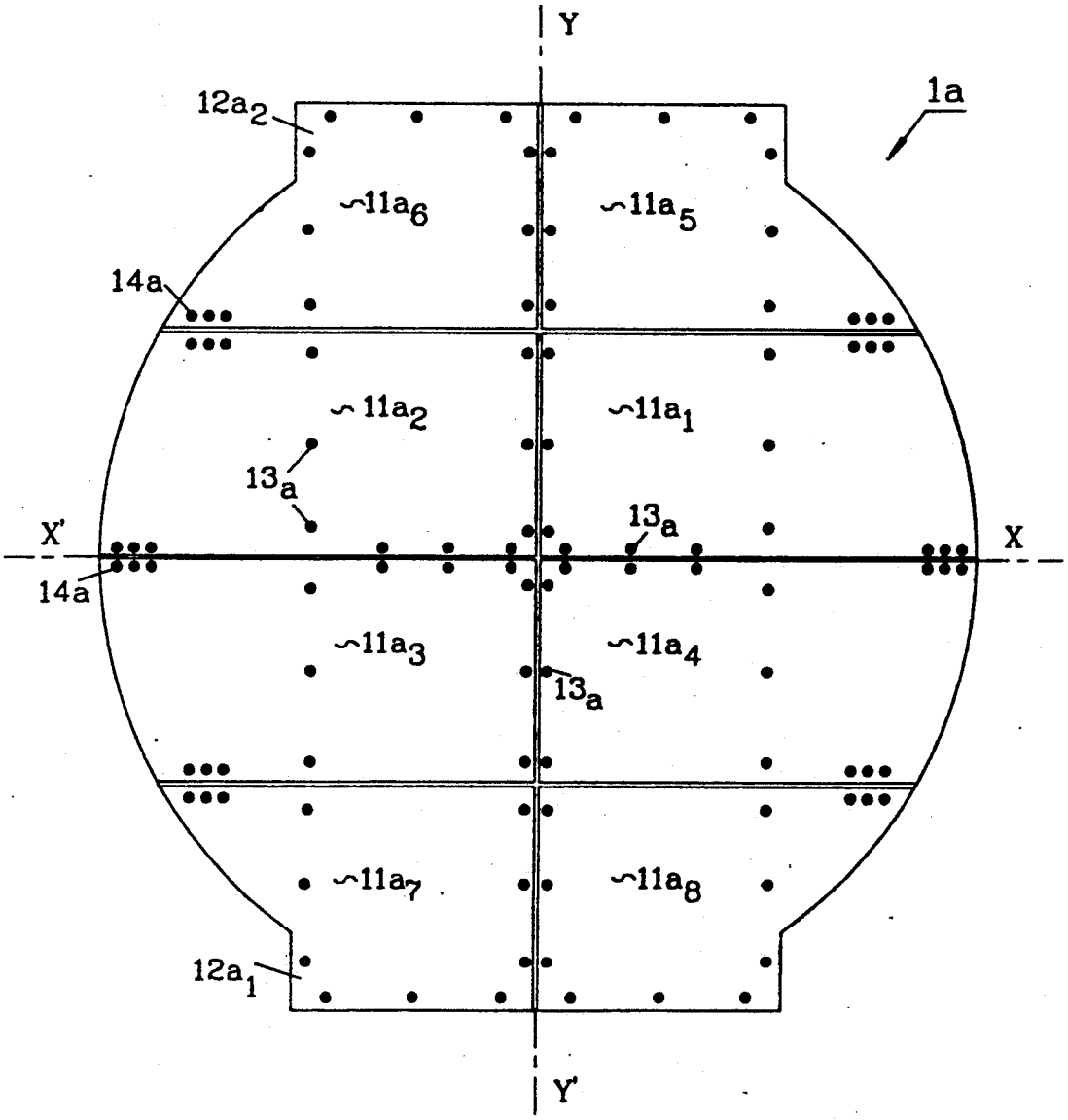
FIGS. 12 and 13 are top views of a reflector and a forming frame according to a second embodiment of the invention, respectively.
Figure 13:
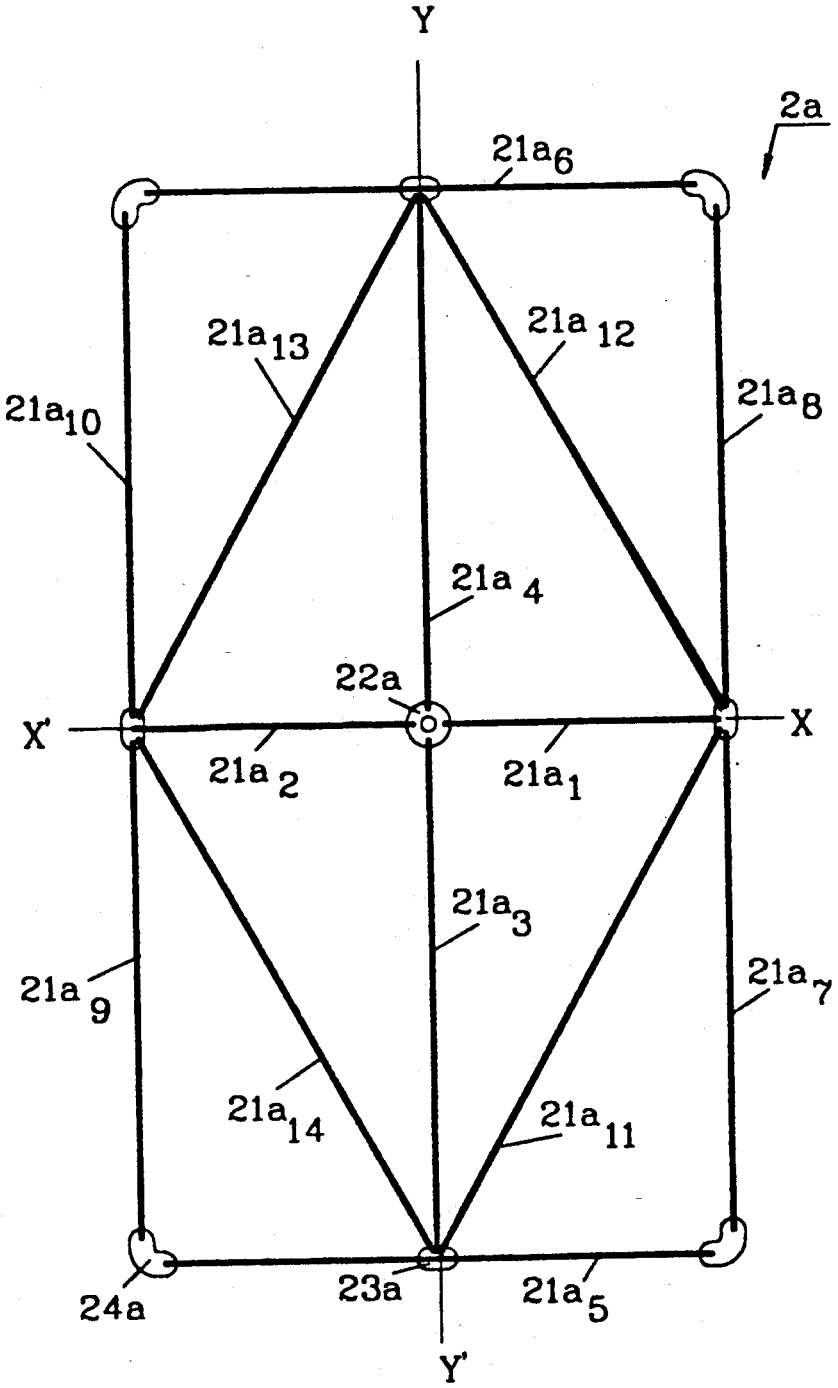

Other embodiments of frame structure with lower convex polygonal base can be devised from the above-mentioned manufacturing and dismounting concepts. In FIGS. 12 and 13 are shown a frame 2*a* with a parallelepiped structure for a reflector 1*a* similar to the reflector 1. The frame 2*a* comprises two pairs of panels $21a_1$, $21a_2$ and $21a_3$, $21a_4$ aligned with the axes X'X and Y'Y and assembled by means of a 4-branch central hub 22*a*, two small transversal panels $21a_5$ and $21a_6$ parallel to the axis X'X and similar to the panels $21_{10}$ and $21_{13}$, two pairs of longitudinal panels $21a_7$, $21a_8$ and $21a_9$, $21a_{10}$ parallel to the axis Y'Y, and four internal panels $21a_{11}$ to $21a_{14}$ connecting the middles of the external sides of the frame in twos. According to another embodiment, the panels $21a_{11}$ to $21a_{14}$ are aligned in twos according to the diagonals of the frame rectangle. The panels are assembled by eight pairs of adequate flanges 23*a* and 24*a*. In FIG. 12 is shown the locations of the fastening screws 13*a* of the petals $11a_1$ to $11a_8$ of the reflector 1*a* onto duplicate moulded splicing angles on the concave upper longitudinal edges of the panels $21a_1$ to $21a_{14}$, supposed thin in this instance. Staples 14*a* are provided at the butt-jointed junctions of the petals $11a_1$ to $11a_8$ on the contour of the reflector 1*a* in order to preserve the surface continuity of the reflector against its own bending.

During in-situ assembling of the reflector and frame, the panels of the frame are laid out on the ground. The next step is to assemble the source carrier mast 3, the elevation angle mast 5 and the azimuth positioner 6.

Figure 14:
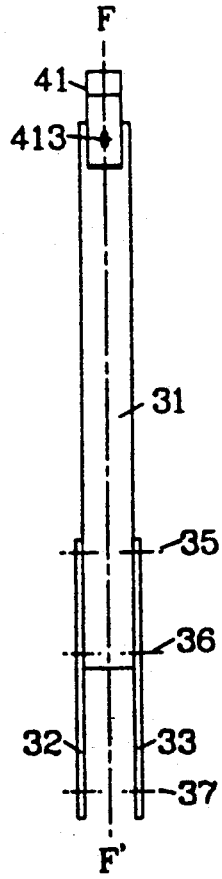
FIGS. 14 and 15 are respectively rear and longitudinal side views of a source carrier mast according to a first embodiment, respectively.
Figure 15:
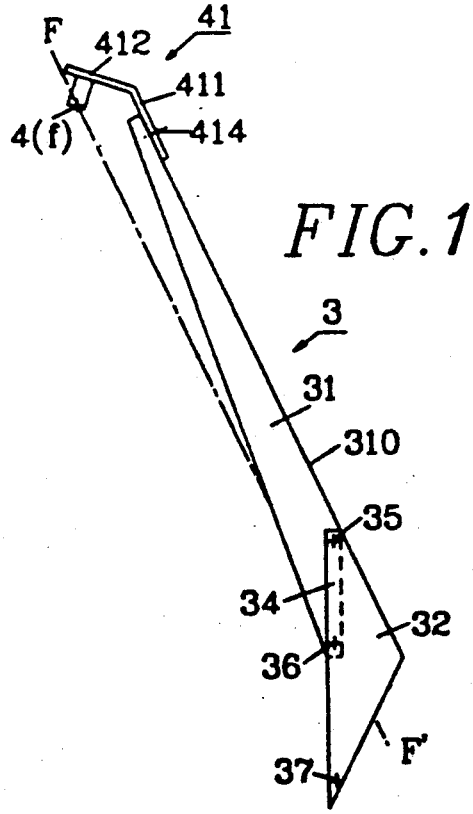

According to a first embodiment shown in FIGS. 14 and 15, the source carrier mast 3 essentially comprises a box plate type girder 31 overhanging the reflector and two flat fastening posts substantially in the form of an isosceles triangle 32 and 33. A mechanism plate 41 is attached to the upper part of the girder 31 and carries the hyperfrequency source 4. The four parts 31, 32, 33 and 41 are in a light material similar to that of the reflector petals and the frame panels, and are preferably of the sandwich structure type comprising a core in PMMA foam or in honeycombs of the NOMEX type manufactured by DU PONT DE NEMOURS, the sides of the core being covered by carbon fibers films.

The girder 31 has a hollow rectangular section with a constant width of 0.4 m and a height decreasing toward the top over a length of 3 m. An interior side 34 of the girder 31, which is normally perpendicular to the plane X'X-Y'Y of the reflector, has an upper end 35 bolted to upper pointed tops of the posts 32 and 33. The lower end to the girder side 34 and substantially the middle of the major sides of the posts 32 and 33 bracing the side 34 are swivel-mounted around an axis 36 substantially coplanar with the plane X'X-Y'Y and parallel to the axis X'X. This swivel axis 36 is fastened by means of small adequate splicing angles to one, $21_{10}$, of the two lateral panels of the frame 2 parallel to the axis X'X. The lower pointed tops 37 of the posts 32 and 33 are bolted to small splicing angles fastened to the panel of the frame $21_{10}$.

When operated, the lower ends 37 of the posts 32 and 33 are fastened to the frame 2, and the source carrier mast 3 is immobile as shown in FIG. 1. In this position, the rear side 310 of the girder 31 which is not facing the reflector 1 is parallel to the focal axis F'F of the parabolic reflector. The side 310 is used as a referenced for positioning the mechanism plate 41 at the top of the girder.

On both sides of an elbow, the mechanism plate 41 has a flat lower branch 411 and a flat upper branch 412. The branch 411 is applied to the side 310 and comprises at least one adjustment slot 413 parallel to the focal axis F'F and passed through by a bolt 414 attached to the top of the girder 31 so as to slide the mechanism plate 41 in a parallel manner to the axis F'F and thereby to adjust the position of the hyperfrequency source 4 which is supported by the other mechanism plate branch 412. The focal length can thus be adjusted.

When not operated, the lower ends 37 of the posts are dismounted from the frame 2, and as the axis 36 is substantially above the reflector 2, the mast 3 can swing around the axis 36 and thus be laid down on the reflector 2. In this position, the mechanism plate 41, or just the source 4, or even just the mast 3 can be separated from the frame 2 and dismantled, without for that matter using ladders and dismounting the elevation angle mast 5 which can be fastened to the same external panel $21_{10}$ as the source carrier mast 3, as shown in FIG. 1. During dismounting of the source carrier mast 3, the mechanism plate 41 is placed in a box with the source 4 without separating the latter from the mechanism plate, and the posts 32 and 33 are separated from the girder 31 so as to fit them easily into the hold of a plane.

Figure 16:
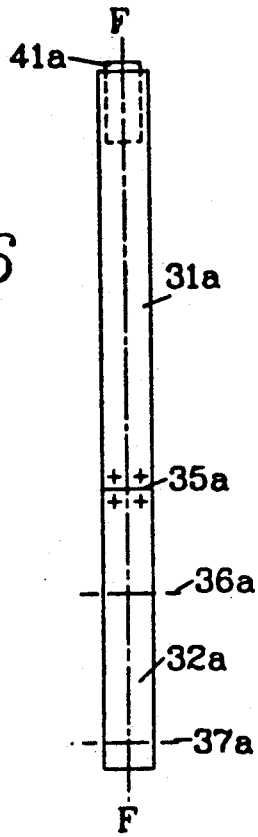
FIGS. 16 and 17 respectively are rear and longitudinal side views of a source carrier mast according to a second embodiment.
Figure 17:
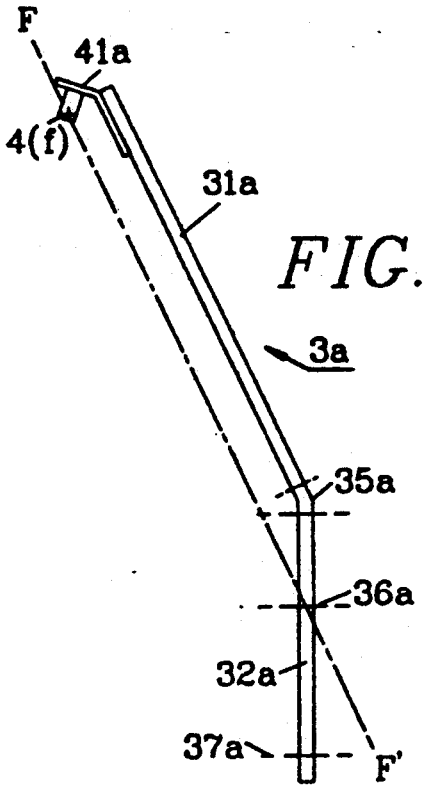

Another embodiment of the source carrier mast 3*a* is shown in FIGS. 16 and 17. The mast 3*a* then comprises one single thin and solid girder which is in fact s comprised of two plates 31*a* and 32*a* connected by adequate splicing angles at the level of an elbow 35*a* of the mast. The upper plate 31*a* is parallel to the focal axis F'F when the bottom 37*a* of the lower plate 32*a* is fastened against the panel of the frame $21_{10}$ and parallel to the axis Z'Z. The central portion of the plate 32*a* is swivel-mounted around axes 36*a* parallel to the axis X'X, like the flanges 32 and 33. The front side of the plate 31*a*, facing the reflector in this instance, supports at the top the lower wing of an elbowed mechanism plate 41*a*, similar to the mechanism plate 41.

In reference to FIGS. 18 and 19, the elevation angle mast 5 essentially comprises a lower tube 50 with an outside diameter of 80 mm, an upper tube 51 with an outside diameter of 100 mm, a slide part 52 to be connected to the forming frame 2 of the antenna , and an idle pulley set for a winch TR cable CA.

The lower tube 50 comprises a foot 53 which comprises, on the lower part 501, a fork 531 with two semicircular branches for resting it on the ground s, and, on the upper part, a tubular joining piece 532 which can be fitted into the lower end of the tube 50 abutting against the seat of the fork 531. The tubular joining piece 532 houses a pulley 533 of which the axis is radial to the tube 50 and which is positioned substantially above a lower cable-passage hole 501 in the tube 50. In the upper end 502 of the tube 50, another tubular joining piece 54 also comprising a pulley 541 can also be fitted in abutment. The axis of the pulley 541 is substantially offset, to the left according to FIG. 19, with regard to the longitudinal axis of the tube 50, so that the pulley 541 substantially protrudes through an upper slot 503 of the tube 50.

The upper tube 51 also comprises two tubular joining pieces 55 and 56 fitted with pulleys. The lower joining piece 55 can be plugged in abutment into the lower end 511 of the tube 51 and receives by axial sliding the lower tube 50, by the upper end 502 with joining piece 54. The joining piece 55 comprises a pulley 51 of which the axis is perpendicular to the axis of the tube 51 and which is situated outside the end of the tube 511, in front of a longitudinal slot 513 of the latter. The upper joining piece 56 of the second tube 51 has a T-shaped longitudinal profile of which the vertical leg can be fitted into the upper end 512 of the tube 51. One of the horizontal wings of the T-shaped profile supports a pulley 561 of which the axis is parallel to that of the pulley 551 and is situated at the same distance from the axis of the tube 51. The other wing of the T-shaped joining piece 56 comprises a device 562 for catching an upper end of the cable CA. The devices 561 and 562 are substantially symmetrical with regard to the tube 51, and more particularly are situated above and on both sides of a pulley with a radial axis 521 mounted outside the tubular slide part 52.

The slide part 52 can be frictionally slid along the upper tube 51, between appropriate stops at the ends 511 and 512. An axis 523 is pressed into the slide part 52 perpendicularly to the longitudinal axis of the tube 51 and to the axis of the pulley 521 and is mounted turning in a fork 524 fastened by a supporting plate 525 (FIGS. 20 and 21) in the lower part of one of the small external panels of the frame. In reference to FIG. 1, the fork 524 is fastened to the panel $21_{10}$ and is situated substantially between and below the posts 32 and 33 of the source carrier mast 3.

The upper tube 51 can frictionally slide along and around the lower tube 50, with a stroke limited by appropriate stops between the pulleys 533 and 561.

The foot 53 with rounded ends 531 enables the mast 5 to be inclined in relation to the ground s, when lifting the frame 2 which rests on two stable supporting points by means of the azimuth positioner 6, as will be seen hereinafter. These two supporting points are opposed to the foot 53 with regard to the central axis Z'Z of the frame, and, of course, the elevation angle mast s always remains in the mid-perpendicular plane of these two supporting points. For instance, as shown in FIG. 1, when the mast 5 is fastened by means of the articulation axis 523 along the vertical axis of the frame panel $21_{10}$, the two other supporting points on the ground are situated at the level of the frame edges 24 bordering the opposite panel $21_{13}$.

According to the diagram in FIG. 19, the cable CA runs along from an electric winch TR laid on the ground s, firstly entering the lower tube 50 via the hole 501, then winding round the lower pulley 533. The cable CA runs along the inside of the tube 50 and over the upper pulley 541 inside the tube 50. The cable CA exits the tube 50 via the slot 503 and runs back down into the lower end 511 of the upper tube 51, running along the upper end 502 of the lower tube 50 before finally exiting the tube 51 via the lower slot 513 and winding around the underside of the external pulley 551. The cable CA then stretches outside the tube 51, from the pulley 551 to the pulley 561, winding round the upper side of the latter. Finally, the cable runs back down and winds round the lower side of the external pulley 521 of the slide part 52 and returns up to fasten an upper cable end at 562. The elements 561, 521 and 562 thus form a double purchase gun tackle attached to the upper end 56 of the mast 5.

When the mast 5 is at rest, the tube 51 almost covers the tube 50, and the slide part 52 is in a low position on the tube 51, the frame 2 being virtually horizontal. A traction of the cable CA by the winch TR enables the pulley 551 to be brought nearer the pulley 541 and thus the tube 51 to be raised by sliding along the tube 50 lying on the ground s, and enables the pulley 521 of the slide part 52 to be brought toward the upper end 512 of the mast supporting the pulley 561. These two nearing adjustments can be carried out one after the other or almost simultaneously as a function of the relative frictions between the two tubes 50 and 51 and between the tube 51 and the slide part 52. As the traction is exerted on the cable CA, the side 2110 of the frame 2 according to FIG. 1 which is articulated with the slide part 52 is raised, the axis Y'Y of the frame becomes increasingly inclined in relation to the ground S and the focal axis F'F tends to near the horizontal axis, while the mast 5 tilts toward the ground and the foot 53 swivels on the ground.

Figure 22:
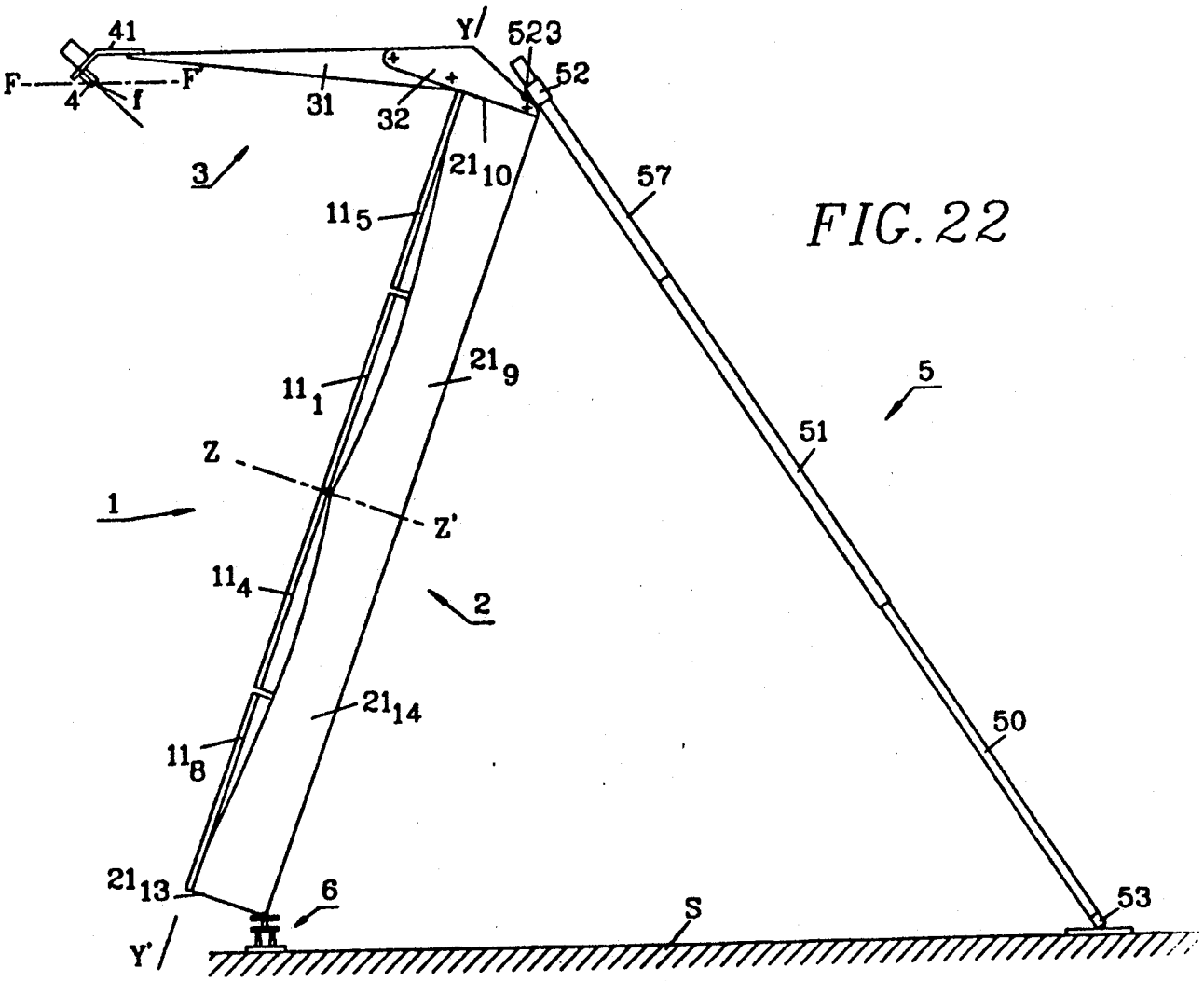
FIGS. 22 and 23 are schematic diagrams of the antenna according to FIG. 1, with a focal axis of the reflector parallel and perpendicular to the ground, respectively.

For tubes 50 and 51 with a length of 3 m each, the elevation angle of the focal axis F'F to be aimed at a geostationary satellite can vary from 65° 30', as shown in FIG. 1, to 17°. To cover the elevation angles from 17° to 0°, a mast extension 57 approximately 1.8 m long prolongs the upper end 512 of the tube 51 by means of a double tubular joining piece 58, as shown in FIG. 18. In this case, the upper end 572 of the extension piece receives the T-shaped joining piece 56. FIG. 22 shows the mast 5 fitted with the extension piece 57 when the focal axis F'F is placed horizontally; this corresponds e.g. to an antenna situated in a polar region and aimed at a geostationary satellite with a substantially equatorial orbit.

Figure 23:
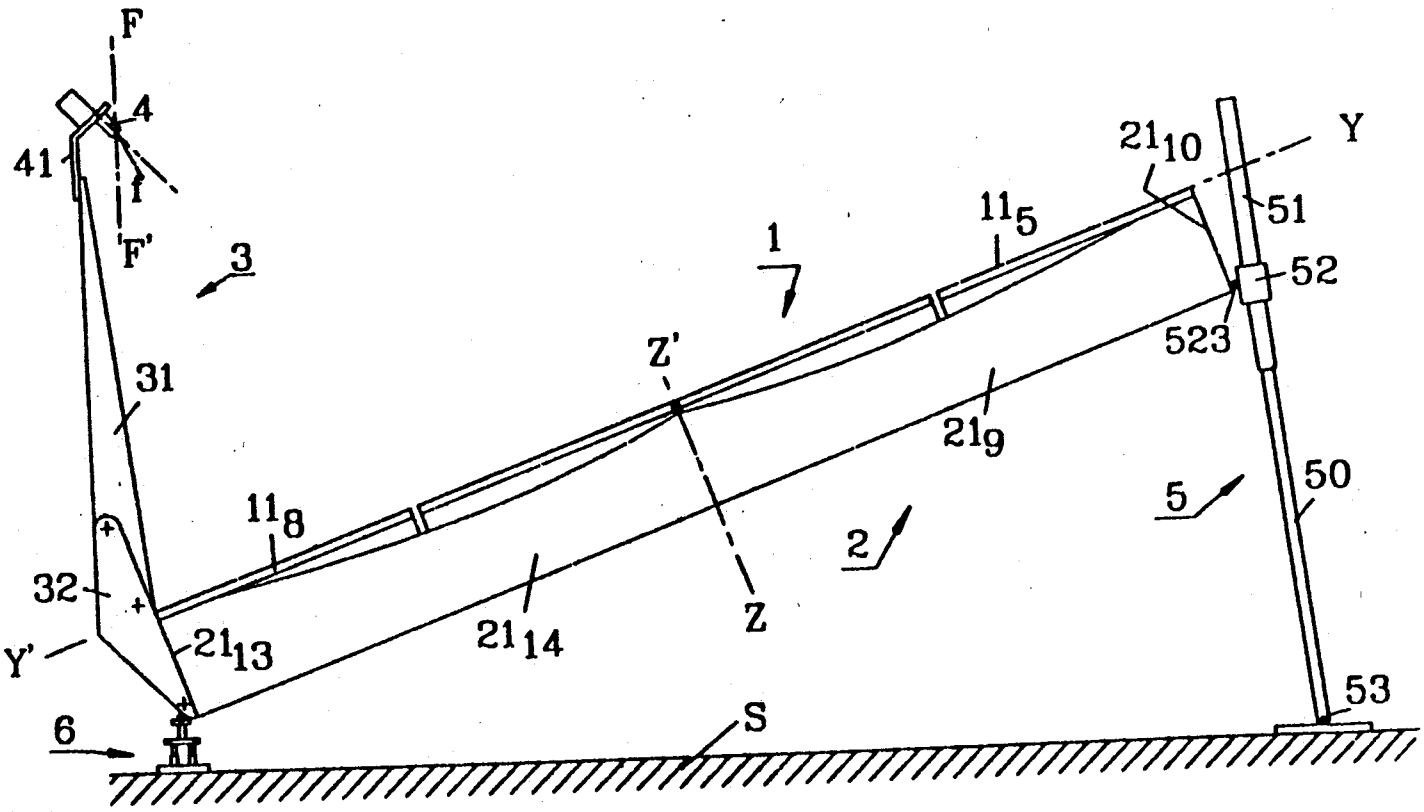

Knowing that the focal axis F'F and consequently the direction of the girder 31 of the source carrier mast 3 are at an angle of 65° 30' with the normally horizontal plane X'X–Y'Y to which the panels of the frame 2 are perpendicular, it is necessary to fasten the source carrier mast 3 against the small panel of the frame $21_{13}$ opposite the panel $21_{10}$ to which the elevation angle mast 5 is articulated, for the elevation angle of focal axis F'F to vary between 65° 30' and 90°. In FIG. 23, for a 90° elevation for the axis F'F, the antenna has e.g. been transported to an equatorial region and aimed at an equatorial geostationary satellite.

The tubes 50 and 51, the extension piece 57, the slide part 52 and the joining pieces 53, 54, 55, 56 and 58 can be aluminium tubes with a thickness of 5 mm, or carbon tubes with a thickness of 2 mm. The two versions of the mast 5 have similar resistances, but the first version in aluminium weighs approximately 45 kg, whereas the second weighs approximately 20 kg.

With the elevation angle mast 5 can be provided at least one cable and cable-winding anti-fall safety system 58, shown schematically in FIG. 19. The system 58 operates like a safety belt for an automobile. A cable 581 of the system 58 has an end 582 anchored to the ground s, and another end fastened around a cable winder 583 also anchored to the ground s. The cable 581 runs around a pulley 584 fixed to the upper end 512 of the tube 51, and the portion of the cable anchored to the ground at 582 is one with the slide part 52 by means of an adequate fastening 585. In the event of relatively sudden displacement of the slide part 52 or of the tube 51, the system 5 immobilizes these elements 51, 52 in order to keep the mast 5 stiff at a required length and to avoid sudden falling of the frame 2 with the reflector 1 subsequent to a breakage of the traction cable CA or of a pulley, or to failure of the winch TR.

As shown in FIGS. 1 and 2, the azimuth positioner 6 comprises an I-shaped curved girder 61, two blocks $62_1$ and $62_2$ with one or two rollers, and plural screw jacks 63.

Figure 24:
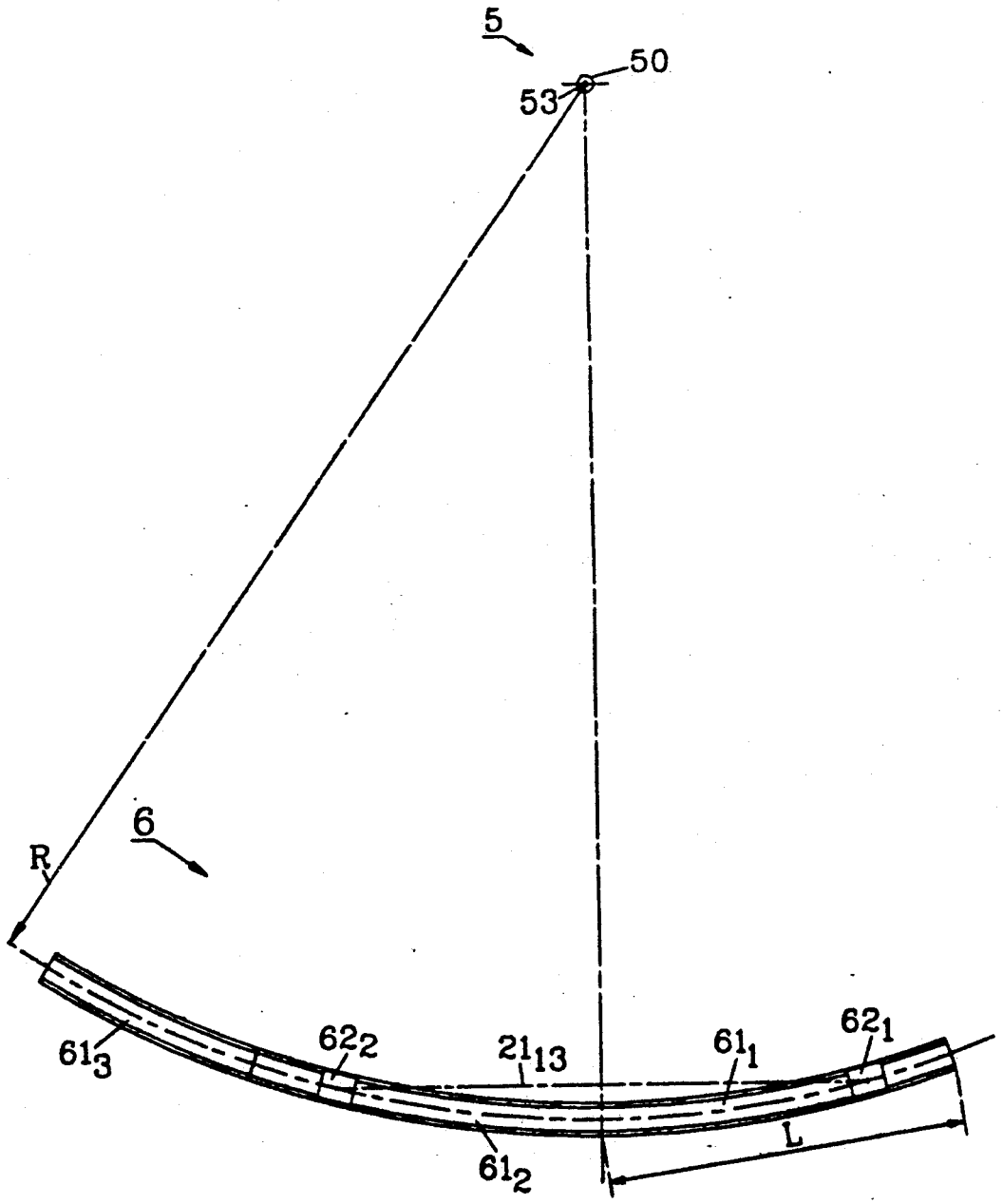
FIG. 24 is a schematic top view of an azimuth positioner of the antenna.

The girder 61 is in fact comprised by three identical curved elements 611 to $61_3$ with an average radius R=6.25 m substantially greater than the length of the frame in order to enable, according to FIG. 24, a rotation of the lateral lower ends of the panel $21_{13}$ sliding on the ground by means of the blocks 621 and $62_2$ around the foot 53 of the tube 50 of the elevation angle mast 5. The length L of each curved element $61_1$ to $61_3$ substantially exceeds the half-length of a small lateral panel $21_{10}$, $21_{13}$ of the frame 2 and therefore the half-distance separating the two blocks $62_1$ and $62_2$, and is in the region of 1.76 m. The length L corresponds to an azimuth variation of 16°. The dividing of the girder 61 into three elements offers the double advantage that the girder is air-transportable, and the single using of the three elements enables azimuth orientations of the antenna from 0° to ±180°. In fact, the frame 2 is e.g. pushed to the left according to FIG. 24, and when the frame 2 and consequently the blocks $62_1$ and $62_2$ are completely situated on the elements $61_2$ and $61_3$, the element $61_1$ is removed and then butt-jointed with the element $61_3$ for the frame to be again swivelled through an azimuthal angle of 16°. The elements $61_1$ to $61_3$ are thus permuted several times to carry out a complete 360° turning of the antenna around a vertical axis through the foot 53 of the mast 5.

As shown in FIG. 25, the girder 61 has an I-shaped transverse profile and comprises a central vertical core 611, a supporting plate 612 in the lower part, and another narrower plate 613 in the upper part.

The plate 613 constitutes a runway for the blocks $62_1$ and $62_2$. As also shown in FIG. 25, each block 62 comprises a roller 620 rolling on the plate 613, and two circular lateral guide flanges 621 laterally bracing the runway 613 and thus retaining and guiding the blocks on the runway 613. A double cap 623 in the upper part of the block 62 receives an articulation axis which is parallel to the axis X'X and therefore forms a chord of the circular runway 613 and which is fastened into one of the two adequate slots made in the frame, in the lower part of the small panel $21_{13}$ near the edges of the latter.

The ends and, if necessary, the middle of each of the curved elements $61_1$ to $61_3$ rest on the ground S by means of three screw jacks or three pairs of screw jacks, as that 63 shown in FIGS. 26 and 27. The screw jack 63 comprises a circular mounting base 631 with four holes 632 for receiving stakes to be anchored into the ground, a tapped cylindrical body 633 screwed to the center of the mounting base, and a threaded rod 634 to be screwed into the cylinder 633 and having a head formed by a rectangular plate 635. The supporting plate 612 of an element $61_1$ to $61_3$ can be fixed to the plate 635 by bolts.

The plates 635 of the various screw jacks 63 are adjusted to a same horizontal level by screwing or unscrewing the rods 634 so as to offset the slope of the ground on which the antenna is installed and to horizontally position the runway girder 61. The cylindrical body 633 of each screw jack is removable from the mounting base 631 so as to interchange it with other cylindrical bodies $633_1$, $633_2$, with different heights, as shown in FIG. 26.

The curved elements $61_1$ to $61_3$ are preferably of the sandwich structure type with a honeycomb core of the NOMEX type and carbon sides. The blocks $62_1$ and $62_2$ are in a light alloy covered with nylon. The screw jacks 63 are mainly in aluminium.

Figure 29:
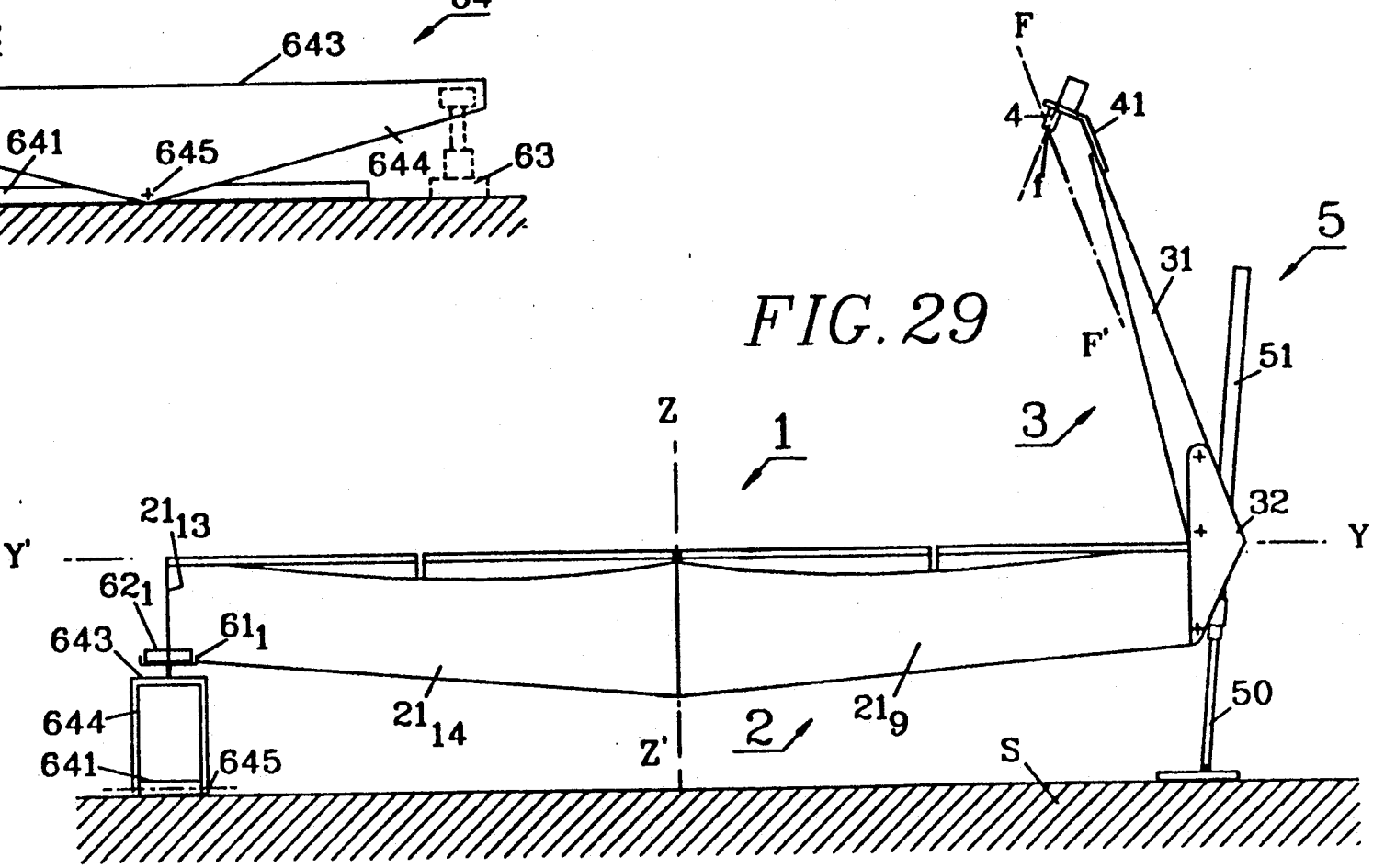
FIGS. 29 and 30 are respectively schematic longitudinal side and top views of the antenna according to FIG. 1, equipped with an azimuth positioner with a swing according to FIG. 28.
Figure 28:
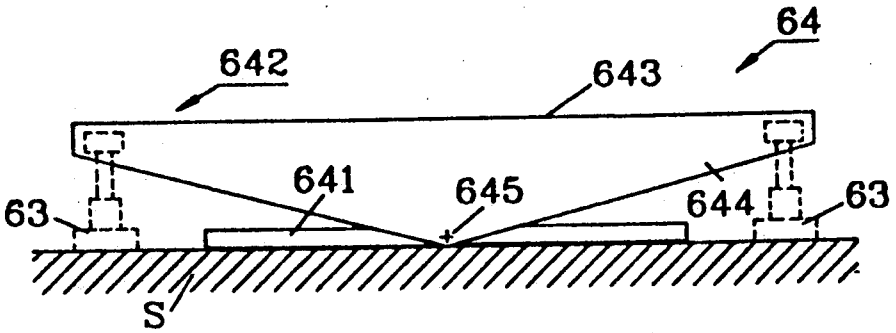
FIG. 28 is a longitudinal side view of a swing for supporting the runway, according to an embodiment of the azimuth positioner.
Figure 30:
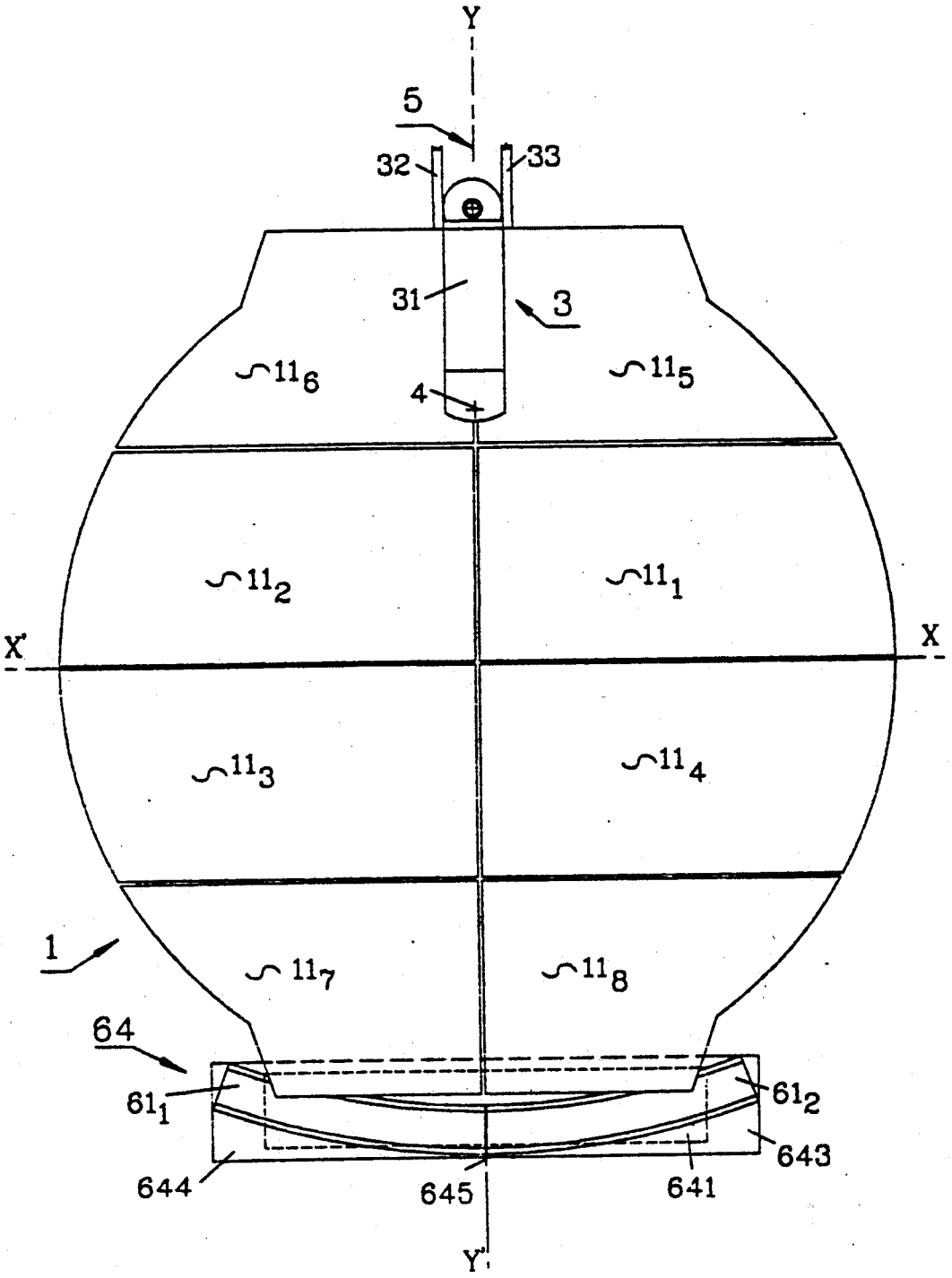

According to another embodiment shown in FIGS. 28, 29 and 30, the screw jacks 63 are replaced by a swing 64. The swing comprises a flat rectangular sole 641 having a length of 3 m, and a support 642 in the form of a plate with a U-shaped vertical section, resulting from the junction of two symmetrical U-shaped plates each with a length of 2 m. The support 642 has a longitudinal bearing girder that is sufficiently long for an azimuth variation of ±6° approximately and sufficiently wide to fasten at least two curved elements $61_1$ and $61_2$ to it. The vertical sides 644 of the support 642 are cut out into an isosceles triangle of which the downward pointed obtuse vertices are rotatably mounted around a horizontal axis 645 that is transversal and medial to the sole 641.

The swing 64 enables the antenna to be maintained in a constant position in relation to a horizontal plane when the antenna is installed on board a ship likely to be subjected to a rolling motion in the region of ±15°. The horizontal axis of the ship is then substantially parallel to the axis 645 of the swing. A triaxial electromechanical control mechanism (not shown) for the azimuthal rotation of the antenna parallel to the axis Z'Z and along the curved elements $61_1$, $61_2$, for the swinging of the swing 64 parallel to the axis Y'Y, and for the inclining of elevation angle mast 5 around the direction X'X, can be provided to maintain the antenna in a given position during zigzaging, rolling and nosing of the ship.

However, the swing 64 can be used on the ground, to immediately correct the slope of a ground. In this case, and after azimuthal positioning of the antenna and, if necessary, balancing of the swing with weights, the slope of the longitudinal bearing girder 643 in relation to the sole 641 is maintained by means of two suitably adjusted screw jacks 63 applied under the ends of the longitudinal girder 643, as shown in broken lines in FIG. 28.

What we claim is:

1. A telecommunication antenna comprising a substantially prismatic frame having a polygonal shape with lower and upper bases, said frame comprising plural substantially rectangular separable frame panels extending substantially perpendicular to said lower base, said frame panels being divided into peripheral panels forming faces of said frame and interior panels located between the center of said frame and edges of said frame formed between said peripheral panels, peripheral tubes carried respectively by said peripheral panels and interior panels, said tubes being located substantially at said frame edges and extending substantially perpendicularly to said frame bases, and plural dismountable peripheral means, each arranged to connect two peripheral tubes of two adjacent peripheral panels and one interior panel, all of which are adjacent each other, interior tubes carried by said interior panels, the interior tubes extending perpendicularly to said frame based and located substantially at said center of said frame and dismountable hub means for connecting all said interior tubes of said interior panels, a parabolic reflector having plural separable reflector elements, each of said reflector elements being thin with a substantially uniform thickness and having at least two perpendicular rectilinear edges respectively parallel to two perpendicular medial axes of said reflector, said frame panels each having a curved upper side which is located at the level of said upper frame base and conformed to the parabolic convex face of said reflector, and dismountable securing means for securing each of said reflector elements onto said curved upper sides of at least one of said peripheral panels and one of said interior panels whereby said rectilinear edges of said reflector elements abut against each other to form a continuous parabolic face of said reflector.

2. The antenna of claim 1 wherein said interior tubes are integral with sides of said interior frame panels which are located at the vicinity of said frame center and extend substantially perpendicular to said frame base, said hub means comprising a first flange located at the level of said lower frame base and supporting first centering stubs for receiving lower ends of said interior tubes, a second flange located at the level of said upper frame base and below said reflector and supporting second centering stubs for receiving upper ends of said interior tubes, and means for connecting said first and second flanges through said interior tubes that have received said first and second centering stubs between said flanges.

3. The antenna of claim 1 wherein said peripheral tubes are integral with sides of said peripheral panels and peripheral sides of said interior panels which extend substantially perpendicularly to said frame bases; each of said dismountable peripheral means comprising a first flange situated at the level of said lower frame base for supporting first centering stubs for receiving lower ends of said peripheral tubes of said adjacent two peripheral panels and interior panel, a second flange situated at the level of said upper frame base and supporting second centering stubs for receiving upper ends of said tubes of said two adjacent peripheral panels and interior panel, and means for connecting said first and second flanges through said peripheral tubes that have received said first and second centering stubs between said flanges.

4. The antenna of claim 1, further comprising a telecommunications signal source to be located substantially on a focal axis of said reflector, the signal source being positioned so it does not intersect the reflector, and a source carrier mast, said carrier mast having a lower part which is attached to one of said peripheral frame panels and an upper part which overhangs said reflector and carries said source thereby locating said source substantially on said focal axis of said reflector.

5. The antenna of claim 4 wherein said lower part of said source carrier mast is swivel-mounted with said upper part of said source carrier mast in order to lay said mast down on said reflector when said antenna is not in use.

6. The antenna of claim 1, comprising a dismountable, telescopic elevation angle mast comprising a lower ground supported upright tube and an upper tube slidable relative to said lower tube, a slide part sliding along said upper tube and articulated to one of said peripheral panels of said frame, and means for lifting said slide part up along said elevation angle mast and for lifting said upper tube relative to said lower tube.

7. The antenna of claim 1 further comprising a dismountable runway and two rolling means for azimuthally orienting said frame, said rolling means being mounted under one of said peripheral panels of said frame and being able to roll on said dismountable runway.

8. The antenna of claim 6, wherein said lifting means comprises a winch on the ground and a cable drawn in by said winch, the cable extending from said winch via pulleys fastened to said elevation angle mast toward a tackle situated in an upper portion of said elevation angle mast, the tackle having a central pulley fixed to said slide part.

9. The antenna of claim 6, comprising anti-fall safety means for blocking said slide part on said elevation angle mast.

10. The antenna of claim 7, wherein said runway is comprised of three separable elements shaped as an arc of a circle having a radius substantially greater than the length of said frame, each of said elements having a length substantially greater than half the distance separating two rolling means.

11. The antenna of claim 7, wherein each of said rolling means comprises a roller having two circular guide and retaining flanges bordering said runway.

12. The antenna of claim 7, further comprising means supporting said runway for offsetting the slope of the ground on which said antenna is installed, in order to horizontally position said runway.

13. The antenna as claimed in claim 7 further comprising a swing resting on the ground and supporting said runway so as to horizontally maintain said runway.

14. A telecommunications antenna comprising plural separable thin reflector elements having a substantially uniform thickness and sides abutting against each other to form a parabolic reflector plural separable frame panels assembled into a substantially prismatic frame for supporting said parabolic reflector, said frame panels extending between edges of said frame and having lower sides defining a lower base of said frame and having curved upper sides adapted to support a convex face of said parabolic reflector elements respectively, a mast having a lower portion that is swivel-mounted to one of said frame panels and an upper portion that carries a telecommunications signal source, overhangs said reflector and is located substantially on a focal axis of said reflector, a dismountable elevation angle mast having a ground supported telescopic tubular means, a slide part slidable relative to said tubular means and articulated to one of said frame panels, means for lifting said slide part up along said tubular means, a dismoutable runway resting on the ground, and rolling means for azimuthally orienting said antenna, said rolling means being adapted to roll on said runway and mounted under at least one of said frame panels that is located opposite to said elevation angle mast with respect to said frame.

15. The antenna as claimed in claim 14, comprising anti-fall safety means for blocking said slide part on said tubular means.

* * * * *

UNITED STATES PATENT AND TRADEMARK OFFICE

CERTIFICATE OF CORRECTION

PATENT NO. : 5,184,145

DATED : February 2, 1993

INVENTOR(S) : Yves DEVILLERS et al

It is certified that error appears in the above-indentified patent and that said Letters Patent is hereby corrected as shown below:

On the title page: Item [73] Assignee

--French State represented by the Minister of the Post, Telecommunications and Space (Centre National D'Etudes Des Telecommunications), Issy Les Moulineaux, France;

Signed and Sealed this

Twentieth Day of December, 1994

*Attest:*

Bruce Lehman

BRUCE LEHMAN

*Attesting Officer*

*Commissioner of Patents and Trademarks*